US007542024B2

(12) United States Patent
Koyama

(10) Patent No.: US 7,542,024 B2
(45) Date of Patent: Jun. 2, 2009

(54) ELECTROPHORESIS DISPLAY DEVICE AND ELECTRONIC EQUIPMENTS USING THE SAME

(75) Inventor: Jun Koyama, Atsugi (JP)

(73) Assignee: Semiconductor Energy Laboratory Co., Ltd., Kanagawa-ken (JP)

( * ) Notice: Subject to any disclaimer, the term of this patent is extended or adjusted under 35 U.S.C. 154(b) by 384 days.

(21) Appl. No.: 10/227,395

(22) Filed: Aug. 26, 2002

(65) Prior Publication Data

US 2003/0048370 A1 Mar. 13, 2003

(30) Foreign Application Priority Data

Sep. 7, 2001 (JP) ..... 2001-272650

(51) Int. Cl.
*G09G 3/34* (2006.01)

(52) U.S. Cl. ..... 345/107; 345/90

(58) Field of Classification Search ..... 345/105, 345/107, 530, 532, 536, 204, 30, 55, 87–100, 345/86; 359/296
See application file for complete search history.

(56) References Cited

U.S. PATENT DOCUMENTS 5,132,820 A * 7/1992 Someya et al. ..... 349/43
5,349,366 A * 9/1994 Yamazaki et al. ..... 345/92
5,945,972 A * 8/1999 Okumura et al. ..... 345/98
6,017,584 A 1/2000 Albert et al.
6,067,185 A 5/2000 Albert et al.
6,118,426 A 9/2000 Albert et al.
6,120,588 A 9/2000 Jacobson
6,120,839 A 9/2000 Comiskey et al.
6,124,851 A 9/2000 Jacobson
6,130,774 A 10/2000 Albert et al.
6,172,798 B1 1/2001 Albert et al.
6,177,921 B1 1/2001 Comiskey et al.
6,232,950 B1 5/2001 Albert et al.
6,249,271 B1 6/2001 Albert et al.
6,252,564 B1 6/2001 Albert et al.
6,262,706 B1 7/2001 Albert et al.
6,262,833 B1 7/2001 Loxley et al.
6,335,778 B1 * 1/2002 Kubota et al. ..... 349/151
6,339,417 B1 * 1/2002 Quanrud ..... 345/98

(Continued)

OTHER PUBLICATIONS

P. Kazlas, "12.1: 12.1" SVGA Microencapsulated Electrophoretic Active Matrix Display for Information Appliances, SID 01 Digest, pp. 152-155, no date given.

(Continued)

*Primary Examiner*—Regina Liang
(74) *Attorney, Agent, or Firm*—Eric J. Robinson; Robinson Intellectual Property Law Office, P.C.

(57) ABSTRACT

An object of the present invention is to provide an active matrix type electrophoresis display device whose number of the times of writings is further smaller. In an electrophoresis display device which performs the display of picture using a n-bit digital picture signal, the respective pixels are divided into a plurality of sub-pixels, the respective sub-pixels have a 1-bit memory circuit. Since an electrophoresis element is stable in once written state, upon the display of static picture, the picture is retained by the digital picture signal retained in a memory circuit, therefore, a periodic refresh operation which is conventionally considered to be required are capable of being omitted.

23 Claims, 21 Drawing Sheets

U.S. PATENT DOCUMENTS

| | | | | |
|---|---|---|---|---|
| 6,518,945 | B1 * | 2/2003 | Pinkham | 345/92 |
| 6,563,480 | B1 * | 5/2003 | Nakamura | 345/82 |
| 6,590,346 | B1 * | 7/2003 | Hadley et al. | 315/169.3 |
| 6,636,194 | B2 * | 10/2003 | Ishii | 345/98 |
| 6,850,216 | B2 * | 2/2005 | Akimoto et al. | 345/90 |
| 6,876,348 | B2 * | 4/2005 | Murata et al. | 345/90 |
| 6,933,915 | B2 * | 8/2005 | Hidaka et al. | 345/98 |
| 7,038,645 | B2 * | 5/2006 | Ozawa et al. | 345/89 |
| 2001/0022565 | A1 | 9/2001 | Kimura | |
| 2002/0018029 | A1 | 2/2002 | Koyama | |
| 2002/0021274 | A1 | 2/2002 | Koyama et al. | |
| 2002/0021295 | A1 | 2/2002 | Koyama et al. | |
| 2002/0024054 | A1 | 2/2002 | Koyama et al. | |
| 2002/0024485 | A1 | 2/2002 | Koyama | |
| 2002/0033792 | A1 * | 3/2002 | Inoue | 345/107 |
| 2002/0036604 | A1 | 3/2002 | Yamazaki et al. | |
| 2002/0036616 | A1 * | 3/2002 | Inoue | 345/107 |
| 2002/0041266 | A1 | 4/2002 | Koyama et al. | |
| 2002/0044110 | A1 * | 4/2002 | Prache | 345/82 |
| 2002/0075211 | A1 * | 6/2002 | Nakamura | 345/87 |
| 2002/0084967 | A1 * | 7/2002 | Akimoto et al. | 345/90 |
| 2002/0149037 | A1 * | 10/2002 | Shimoda et al. | |
| 2003/0034950 | A1 * | 2/2003 | Liang et al. | 345/107 |
| 2003/0071772 | A1 * | 4/2003 | Kimura | 345/76 |

OTHER PUBLICATIONS

Y. Chen et al., *12.2: A Conformable Electronic Ink Display Using a Foil Based α-Si TFT Array*, SID Digest '01, SID International Symposium Digest of Technical Papers, Jan. 1, 2001, pp. 157-159.

Itoh et al., "40.5: Invited Paper: Super Reflective Color LCD With PDLC Technology," SID 07 Digest, vol. XXXVIII, No. 2, May 2007 pp. 1362-1365.

* cited by examiner

201 : FLIP-FLOPS
202 : SHIFT REGISTER
203 : NAND
204 : FIRST LATCH CIRCUIT
205 : SECOND LATCH CIRCUIT

301 : SOURCE SIGNAL LINE
302 : GATE SIGNAL LINE
303 : SWITCHING TFT
304 : MEMORY CIRCUIT
305 : ELECTROPHORESIS ELEMENT

401~403 : SOURCE SIGNAL LINE
404~406 : GATE SIGNAL LINE
407~409 : SWITCHING TFT
410~412 : MEMORY CIRCUIT
413~415 : ELECTROPHORESIS ELEMENT

600 : MEMORY CIRCUIT (SRAM)
601 : SOURCE SIGNAL LINE
602 : GATE SIGNAL LINE
603 : SWITCHING TFT
604 : ELECTROPHORESIS ELEMENT

611~613 : SOURCE SIGNAL LINE
614 : GATE SIGNAL LINE
617~619 : SWITCHING TFT
620~622 : ELECTROPHORESIS ELEMENT
630 : MEMORY CIRCUIT FOR FIST BIT (SRAM)
640 : MEMORY CIRCUIT FOR SECOND BIT (SRAM)
650 : MEMORY CIRCUIT FOR THIRD BIT (SRAM)

Fig. 8A SECTION SHOWN BY LINE OF A-A'
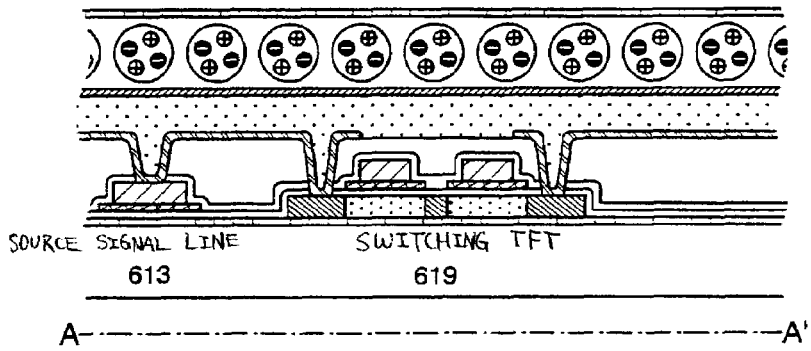
Fig. 8B SECTIONS SHOWN BY LINES OF B-B' AND C-C'
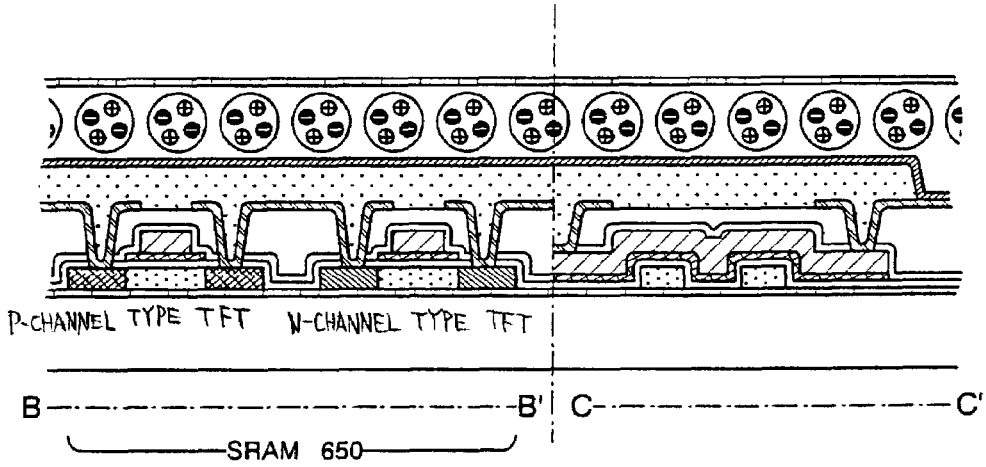

901 : FINE PARTICLE (POSITIVELY CHARGED WHITE)
902 : FINE PARTICLE (NEGATIVELY CHARGED, BLACK)
903 : COUNTER ELECTRODE (TRANSPARENT ELECTRODE)
904, 905 : PIXEL ELECTRODE
906 : MICROCAPSULE

1001 : COUNTER ELECTRODE (TRANSPARENT ELECTRODE)
1002 : FINE PARTICLE (POSITIVELY CHARGED)
1003 : FINE PARTICLE (NEGATIVELY CHARGED)
1004 : MICROCAPSULE
1005 : PIXEL ELECTRODE
1006 : SUBSTRATE

1100 : PIXEL SECTION
1101, 1102 : SOURCE SIGNAL LINE DRIVE CIRCUIT
1103 : GATE SIGNAL LINE DRIVE CIRCUIT
1104 : SOURCE SIGNAL LINE
1105 : GATE SIGNAL LINE
1106 : PIXEL TFT
1107 : PIXEL ELECTRODE
1108 : RETENTION CAPACITOR

Fig.12A FORMATION OF ISLAND-LIKE SEMICONDUCTOR FILM AND GATE INSULATING FILM AND FIRST AND SECOND CONDUCTIVE FILMS

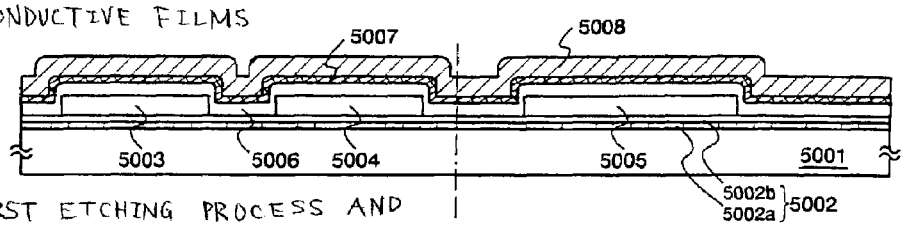

Fig.12B FIRST ETCHING PROCESS AND FIRST DOPING PROCESS

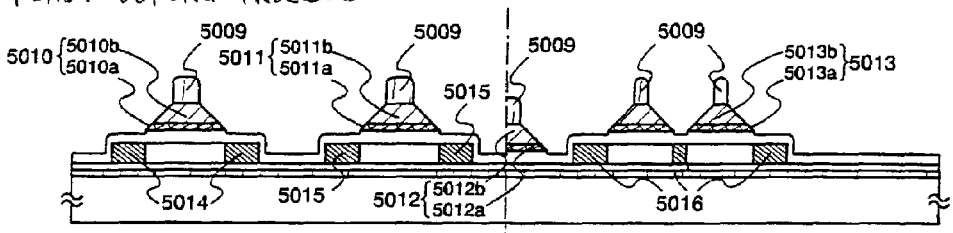

Fig.12C SECOND ETCHING PROCESS AND SECOND DOPING PROCESS

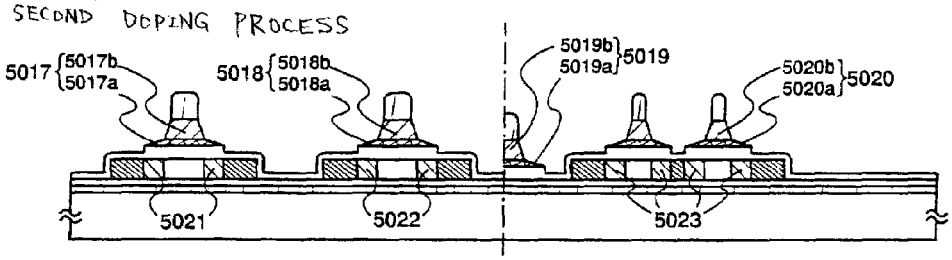

Fig.12D THIRD ETCHING PROCESS

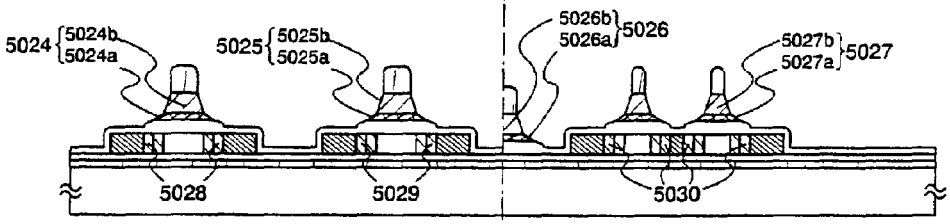

DRIVER CIRCUIT PORTION ← → PIXEL SECTION

5001 : SUBSTRATE
5002 : BASE INSULATING FILM
5003 ~ 5005 : SEMICONDUCTOR LAYER
5006 : GATE INSULATING FILM
5007 : FIRST CONDUCTIVE FILM
5008 : SECOND CONDUCTIVE FILM
5009 : RESIST MASK

5010 ~ 5013 : FIRST SHAPE CONDUCTIVE LAYER
5014 ~ 5016 : FIRST IMPURITY REGION
5017 ~ 5020 : SECOND SHAPE CONDUCTIVE LAYER
5021 ~ 5023 : SECOND IMPURITY REGION
5024 ~ 5027 : THIRD SHAPE CONDUCTIVE LAYER
5028 ~ 5030 : THIRD IMPURITY REGION

Fig.13A THIRD DOPING PROCESS

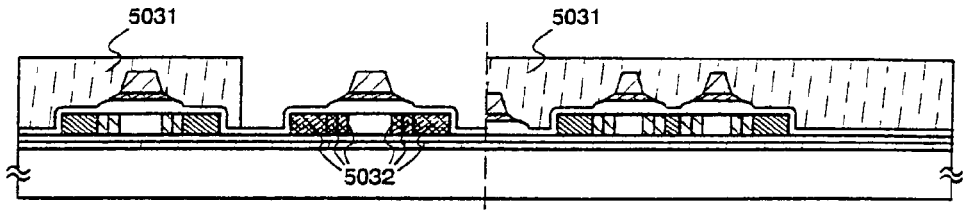

Fig.13B FORMATION OF FIRST AND SECOND INTERLAYER INSULATING FILMS AND WIRINGS

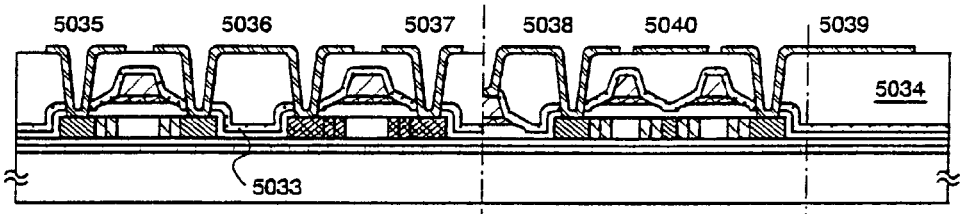

Fig.13C FORMATION OF THIRD INTERLAYER INSULATING FILM AND PIXEL ELECTRODE AND APPLICATION OF MICROCAPSULE AND FORMATION OF COUNTER ELECTRODE

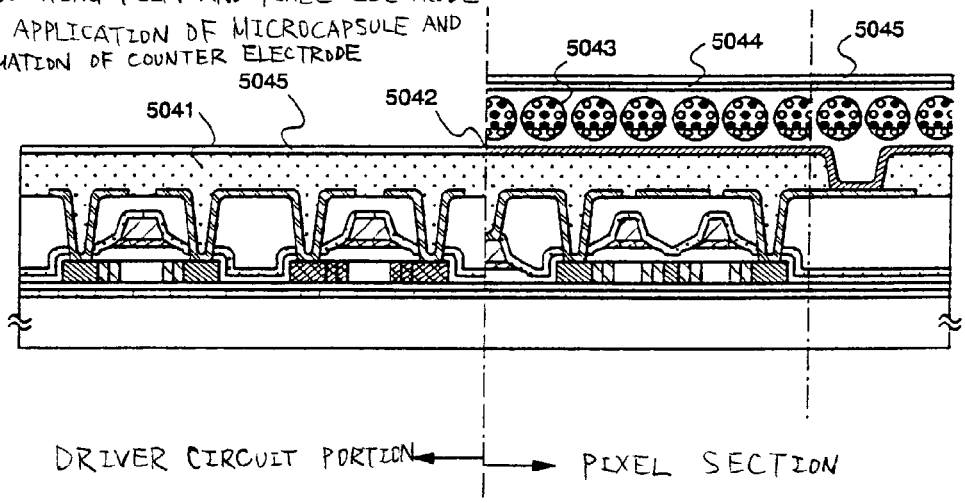

5031 : RESIST MASK
5032 . FOURTH IMPURITY REGION
5033 : FIRST INTERLAYER INSULATING FILM
5034 : SECOND INTERLAYER INSULATING FILM
5035 ~ 5039 : WIRING
5040 : GATE SIGNAL LINE
5041 : THIRD INTERLAYER INSULATING FILM
5042 : PIXEL ELECTRODE (REFLECTIVE ELECTRODE)
5043 : MICROCAPSULE
5044 : COUNTER ELECTRODE (TRANSPARENT ELECTRODE)
5045 : PROTECTIVE FILM

1601 : FLIP-FLOPS
1602 : SHIFT REGISTER
1603 : NAND
1604 : BUFFER

1701 : FLIP-FLOPS
1702 : SHIFT REGISTER
1703 : NAND
1704 : FIRST LATCH CIRCUIT
1705 : SECOND LATCH CIRCUIT

1801 : FLIP-FLOPS
1802 : SHIFT REGISTER
1803 : NAND
1804 : FIRST LATCH CIRCUIT
1805 : SECOND LATCH CIRCUIT
1806 : SELECTION SWITCH

1901 : FLIP-FLOPS
1902 : SHIFT-REGISTER
1903 : NAND
1904 : BUFFER
1905 : MULTIPLEXER

2001 : SOURCE SIGNAL LINE
2004~2006 : GATE SIGNAL LINE
2007~2009 : SWITCHING TFT
2010~2012 : MEMORY CIRCUIT
2013~2015 : ELECTROPHORESIS ELEMENT

ELECTROPHORESIS DISPLAY DEVICE AND ELECTRONIC EQUIPMENTS USING THE SAME

BACKGROUND OF THE INVENTION

1. Field of the Invention

The present invention relates to an electrophoresis display device, and particularly relates to an active matrix type electrophoresis display device having a thin film transistor (hereinafter, referred to as TFT) prepared on an insulating material and using an electrophoresis element as a pixel.

2. Description of Related Art

In SID'01 (Society of Information Displays—2001) held in San Jose in June, 2001, E Ink, Corp. has published an electrophoresis display device, and attracted the great deal of attention. The electrophoresis display device published by E Ink Inc. is a display device in which an electronic ink is used as a material and the electronic ink is printed, thereby constituting the display device.

As shown in FIG. 9, an electronic ink is such a product that an microcapsule 906 having a diameter of about 80 μm is made, in which a transparent liquid, a white particle 901 positively charged and a black particle 902 negatively charged are encapsulated. When the electric field is impressed on the microcapsule 906, the white particle 901 and the black particle 902 are moved in a contrary direction. As shown in FIG. 9, the electric field is positively or negatively impressed between a counter-electrode (transparent electrode) 903 and pixel electrodes 904, 905, the white or black particle appears on the surface, and the white or black color is displayed. As for this electronic ink and the counter-electrode (transparent electrode), films are capable of being formed by a printing method, and an electrophoresis display device is a device that an electronic ink is printed on a circuit substrate.

An electrophoresis display device using an electronic ink has a merit that it consumes less electric power comparing to a liquid crystal device. First, it is since it has around 30% of the reflectance, and has several-fold of reflectance comparing to that of a reflection type liquid crystal. Since a reflection type liquid crystal has a lower reflectance, although it is advantageous at the place where the light is intense, for example, under the sun, at the place where the light is less intense, it is necessary to provide an auxiliary illumination such as a front light or the like. To the contrary, in the case of an electrophoresis display device using an electronic ink, since its reflectance is high, the front light is not needed. As for a front light, several hundreds mW of power is required, however, this power is not required for the device. Moreover, since liquid crystal uses an organic material, if the direct current drive is continued, the deterioration phenomenon will occur. Therefore, the alternating current inversion drive is needed, if the inversion frequency is low, a flicker is visibly recognized, it makes the user feel uncomfortable, therefore, alternating current inversion drive is normally carried out at 60-100 Hz. In an electrophoresis display device, it is not necessary to carry out the alternating current inversion drive as in a liquid crystal, accordingly, it is neither necessary to write at 60 Hz at each time. Owing to the two points described above, a low power consumption is capable of being realized.

E Ink Corp. has published an electrophoresis display device using amorphous silicon (a-Si) TFT in SID'01 DIGEST, p.152-155.

An electrophoresis display device using a-Si TFT is shown in FIG. 11. On the periphery of a pixel section 1100, it has source signal line drive circuits 1101, 1102 and a gate signal line drive circuit 1103 which has been externally mounted and supplied in a form of package such as IC or the like. The respective pixel is consisted of a source signal line 1104, a gate signal line 1105, a pixel TFT 1106, a pixel electrode 1107, a retention capacitor 1108 and the like.

FIG. 10 is a sectional view of a pixel after a microcapsule 1004 which is to be an electronic ink, and a counter-electrode 1001 have been formed, the operation of the particle in the microcapsule 1004 is controlled by the potential of the pixel electrode 1005, and the white or black color is displayed.

As described above, in the conventional electrophoresis display device, since a drive circuit is externally mounted, there have been problems from the viewpoints of cost, size of frame, reliability of terminal connection and the like.

Moreover, in the case where an electrophoresis display device is configured by employing a TFT substrate for amorphous, in order to retain the potential applied to the pixel electrode, the writing corresponding to the time constant determined by the retention capacitance of the pixel and off-state current of the pixel TFT has to be carried out. As for this, it is not required to write at 60 Hz as in employing the countermeasure for flicker, however, it requires refresh writing in a cycle of a certain length. Hence, in order to reduce the power consumption, a novel electrophoresis display device which is not required to write unless the picture is changed is needed.

SUMMARY OF THE INVENTION

Hence, an object of the present invention is to provide an active matrix type electrophoresis display device whose number of times of writings is further smaller than that of the conventional ones.

By building in a driver circuit in said electrophoresis display device of the present invention, the improvement of cost, power consumption and the reliability of a terminal portion can be aimed. Further, by building in a high maintenance memory circuit in a pixel portion, the writing frequency is decreased, and the electrophoresis display device with little power consumption is offered.

As follows, the constitution of the electrophoresis display device of the present invention is described. However, a source region and a drain region are difficult to distinguish clearly due to the structure of TFTs. Therefore, in this specification, in case of describing the connection of a circuit, of the source region and drain region of TFTs, either of them is denoted as an input electrode, while the other is denoted as an output electrode.

In the present invention, an electrophoresis display device is offered, said electrophoresis display device, wherein a microcapsule into which a plurality of charged particles are embedded is disposed on a plurality of pixel electrodes, light and darkness are displayed by controlling said charged particles with the potentials of said pixel electrodes, said electrophoresis display device, wherein said pixel electrodes are separately connected to memory circuits, respectively, the potentials of said pixel electrodes are controlled by memory data of memory circuits.

In the present invention, an electrophoresis display device is offered, said electrophoresis display device, in which a microcapsule into which a plurality of charged particles are embedded is disposed on a plurality of pixel electrodes, light and darkness are displayed by controlling said charged particle with the potentials of said pixel electrodes, said electrophoresis display device, wherein it has a plurality of pixel electrodes on a substrate, said pixel electrode is consisted of a plurality of sub-pixel electrodes, said sub-pixel electrodes are separately connected to memory circuits, respectively, and the potentials of said sub-pixel electrodes are controlled by memory data of memory circuits.

In the present invention, an electrophoresis display device is offered, said electrophoresis display device having a source signal line drive circuit, a gate signal line drive circuit, and a pixel section in which x×y pieces of pixels are disposed in a matrix shape and performing a display of a picture by inputting a n-bit digital picture signal, said electrophoresis display device, wherein, said x×y pieces of pixels have n-lines of source signal lines, gate signal lines and n pieces of sub-pixels, respectively, said n pieces of sub-pixels have a transistor for switching, a memory circuit and a pixel electrode, respectively, a gate electrode of said transistor for switching is electrically connected to said gate signal line, respectively, an input electrode is electrically connected to any one of these different from each other out of said n-lines of source signal lines, and an output electrode is electrically connected to a pixel electrode via said memory circuit, said source signal line drive circuit has, means for in turn outputting sampling pulses in accordance with a clock signal and a start pulse, means for retaining a n-bit digital picture signal in accordance with said sampling pulse, means for transferring said retained n-bit digital picture signal, and means for outputting said transferred n-bit digital picture signal into n×x lines of source signal lines in parallel, said gate signal line drive circuit has, at least means for outputting gate signal line selection pulses which in turn select one of y-lines of gate signal lines in accordance with a clock signal and a start pulse, and pixel electrodes that said sub-pixels have are separately connected to each one of said memory circuits, respectively, and the potentials of said pixel electrodes are controlled by memory data of said memory circuits.

In the present invention, an electrophoresis display device is offered, said electrophoresis display device having a source signal line drive circuit, a gate signal line drive circuit, and a pixel section in which x×y pieces of pixels are disposed in a matrix shape and performing a display of a picture by inputting a n-bit digital picture signal, said electrophoresis display device, wherein, said x×y pieces of pixels have source signal lines, n-lines of gate signal lines and n pieces of sub-pixels, respectively, said n-pieces of sub-pixels have a transistor for switching, a memory circuit and a pixel electrode, respectively, a gate electrode of said transistor for switching is electrically connected to any one different from each other out of said n-lines of gate signal lines, respectively, an input electrode is electrically connected to said source signal line, and an output electrode is electrically connected to a pixel electrode via said memory circuit, said source signal line drive circuit has, means for in turn outputting sampling pulses in accordance with a clock signal and a start pulse, means for retaining a n-bit digital picture signal in accordance with said sampling pulse, means for transferring said retained n-bit digital picture signal, and means for in turn selecting said transferred n-bit digital picture signal per each one bit and outputting said transferred n-bit digital picture signals into n×x lines of source signal lines, said gate signal line drive circuit has, at least means for outputting gate signal line selection pulses which in turn select n×y-lines of gate signal lines in accordance with a clock signal, a start pulse and a multiplex signal, and pixel electrodes that said sub-pixels have are separately connected to each one of said memory circuits, respectively, and the potentials of said pixel electrodes are controlled by memory data of said memory circuits.

In the present invention, said memory circuit can be comprised of a SRAM, and also can be comprised of a non-volatile memory.

Electronic apparatuses using said electrophoresis display device of the present invention, such as a portable information terminal, a video camera, a digital camera, a personal computer, a television or the like can be offered.

BRIEF DESCRIPTION OF THE DRAWINGS

For a more complete understanding of the present invention and the advantages thereof, reference is now made to the following detailed description taken in conjunction with the accompanying drawings, in which:

FIGS. 8A and 8B are drawings showing the sectional views of a pixel using a SRAM for a memory circuit;

FIGS. 12A, 12B, 12C and 12D are sectional views for illustrating the steps of the present invention;

FIGS. 13A, 13B and 13C are sectional views for illustrating the steps of the present invention;

DESCRIPTION OF THE PREFERRED EMBODIMENTS

Embodiment 1

Hereinafter, the configuration of an electrophoresis display device of the present invention will be described. An electrophoresis display device of the present invention has a source signal line drive circuit or a gate signal line drive circuit or both of these on an insulating substrate, and has a thin film transistor for switching and a memory circuit in a pixel region.

Figure 1:
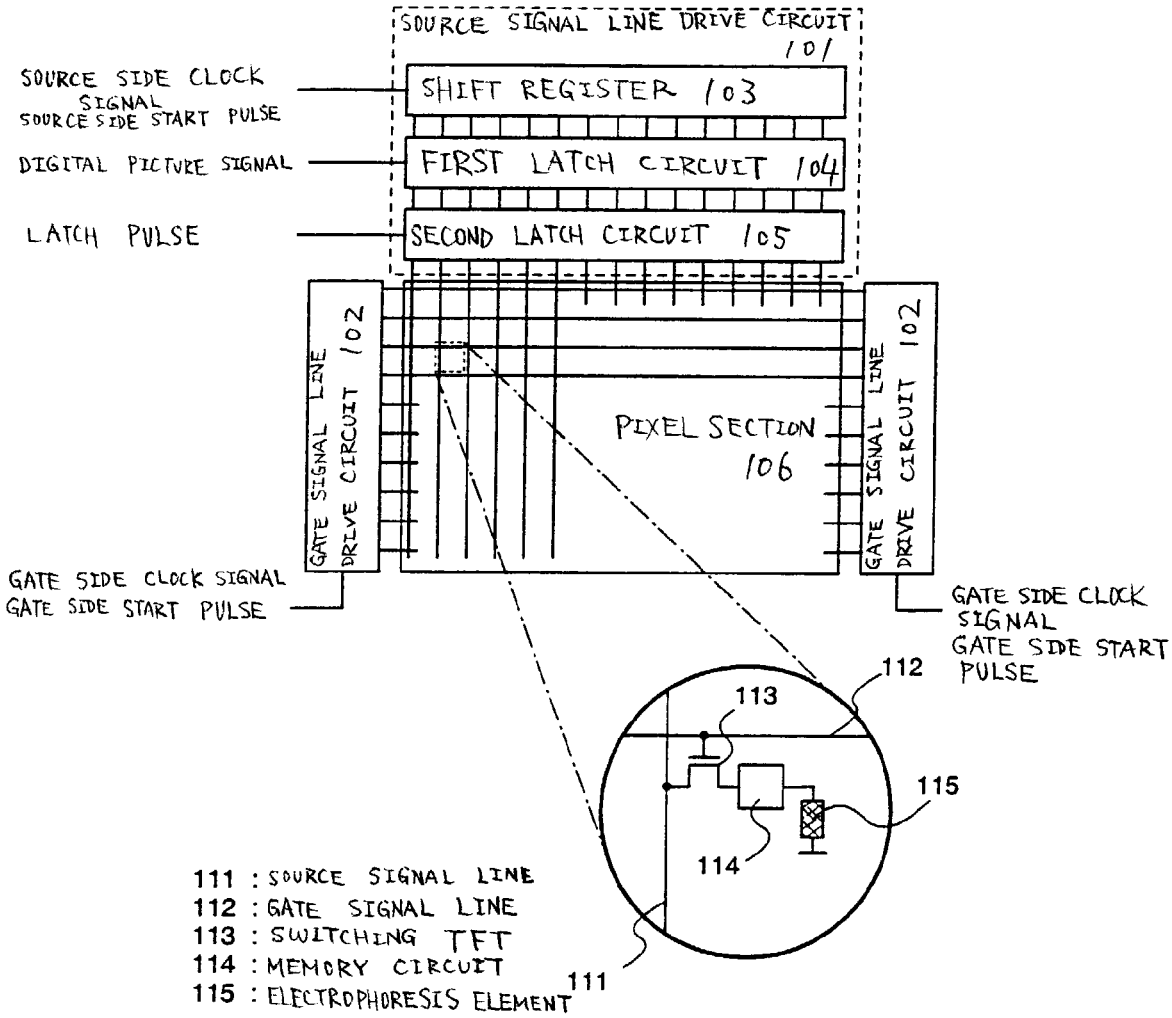
FIG. 1 is a diagram showing a configuration example of an electrophoresis display device of the present invention.

FIG. 1 shows one Embodiment of an electrophoresis display device of the present invention. Hereinafter, the operation will be described.

A pixel section 106 is disposed in the center. The upper side of the pixel section, a source signal line drive circuit 101 is disposed for the purpose of controlling a signal to be inputted into the source signal line. The source signal line drive circuit 101 has a first latch circuit 104, a second latch circuit 105 and the like. On the right and left sides of the pixel section, a gate signal line drive circuit 102 for controlling a signal to be inputted into the gate signal line. It should be noted that in FIG. 1, although the gate signal line drive circuits 102 are disposed on both of the right and left sides of the pixel section, the circuits may be disposed on one side of it. However, the disposing them on both sides is more desirable from the viewpoints of drive efficiency and drive reliability.

Figure 2:
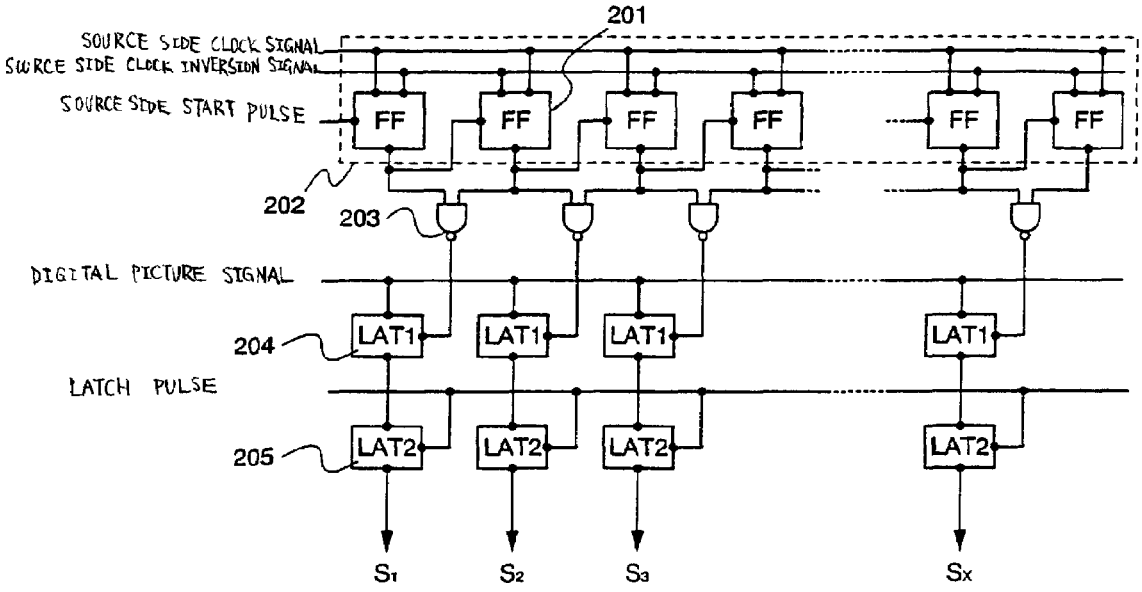
FIG. 2 is a diagram showing a configuration example of a source signal line drive circuit.

The source signal line drive circuit 101 has the configuration as shown in FIG. 2. The source signal line drive circuit shown as one example in FIG. 2 is a source signal line drive circuit corresponding to an electrophoresis display device, which has x pieces of pixels in the horizontal direction, performs the display of a 2-step gradation by inputting a 1-bit digital picture signal and has a shift register 202 comprising utilizing a plurality of rows of flip-flops (FF) 201, a NAND 203, a first latch circuit (LAT1) 204, a second latch circuit (LAT2) 205 and the like. Here, as for the NAND 203, it may not be particularly provided depending upon the configuration of the shift register 202. Moreover, although it is not shown in FIG. 2, if necessary, a buffer circuit, a level shifter circuit or the like may be disposed.

The operation will be briefly described with reference to FIG. 2. First, a source side clock signal, a source side clock inversion signal and a source side start pulse are inputted into the shift register 202, and in accordance with it, sampling pulses are in turn outputted from the shift register 202. In FIG. 2, as for the sampling pulse, although it is made so that the duplication of the pulses does not occur in the adjacent row by means of the NAND 203, the procedure may not be particularly provided. Subsequently, the sampling pulse outputted from the NAND 203 is inputted into the first latch circuit 204, and in accordance with the timing, and is going to retain a digital picture signal similarly having been inputted into the first latch circuit 204, respectively.

In the first latch circuit 204, when the retaining of the digital picture signal by the portion of one horizontal cycle is completed, a latch pulse is inputted during the retrace line period, the digital picture signals retained in the first latch circuit 204 are all together transferred to the second latch circuit 205.

Subsequently, again the shift register circuit 202 operates, the sampling pulse is outputted, and the retention of the digital picture signal by the portion of the next horizontal cycle is initiated. At the same time, the digital picture signals retained in the second latch circuit 205 are inputted into the source signal lines (represented as S1, S2 . . . , and Sx in FIG. 2) and written into each pixel.

Figure 16:
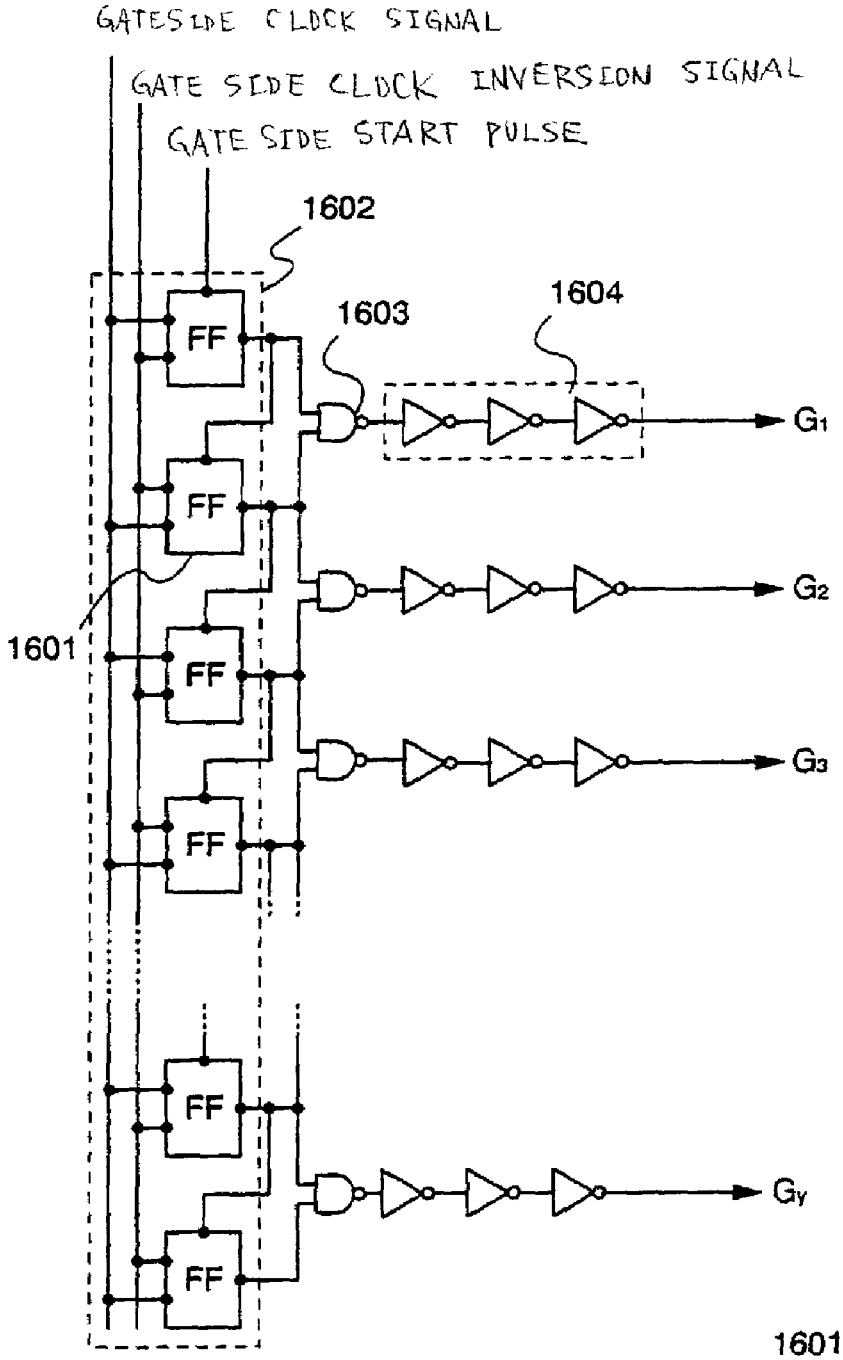
FIG. 16 is a diagram showing a configuration example of a gate signal line drive circuit.

The gate signal line drive circuit 102 has the configuration as shown in FIG. 16. The gate signal line drive circuit shown as an example in FIG. 16 has y pieces of pixels in the vertical direction, a shift register 1602 comprising utilizing a plurality of rows of flip-flops (FF) 1601, a NAND 1603, a buffer 1604 and the like. Here, as for the NAND 1603, it may not be particularly provided depending upon the configuration of the shift register 1602, and the number of rows of the buffers 1604 is not always limited to this. Moreover, although it is not shown in FIG. 16, if necessary, the level shifter circuit or the like may be disposed.

The operation will be described below with reference to FIG. 16. First, a gate side clock signal, a gate side clock inversion signal and a gate side start pulse are inputted into the shift register 1602, and in accordance with it, the pulses are in turn outputted from the shift register 1602. In FIG. 16, it is made so that the outputting timing of the pulse of the adjacent row is not duplicated using the NAND 1603. Subsequently, the pulse passes through the buffer 1604, and in turn selects the gate signal line. A period during which a certain gate signal line is selected is one horizontal period.

Figure 3A:
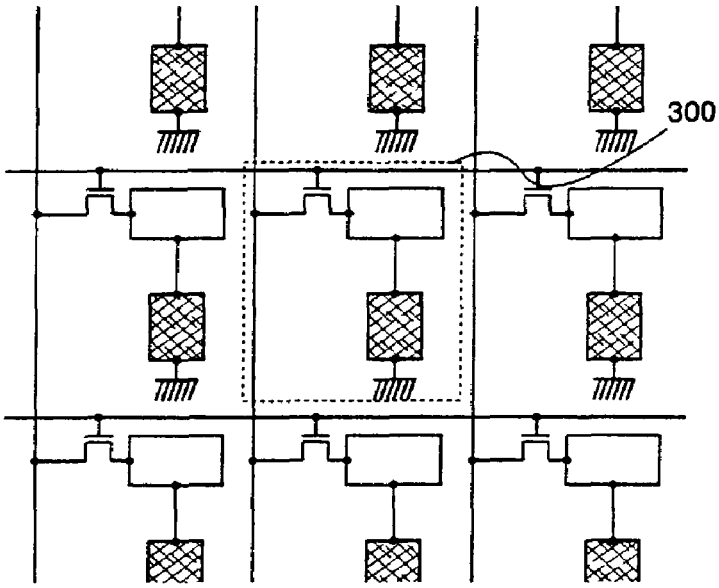
FIGS. 3A and 3B are diagrams showing a configuration example of a pixel of the present invention.
Figure 3B:
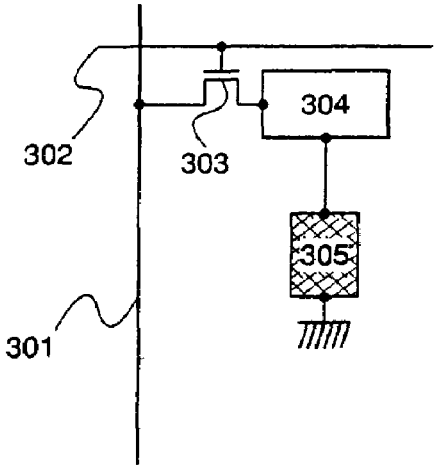

In FIG. 3, the configuration of the pixel section of an electrophoresis display device of the present invention is shown. In FIG. 3A, the portion surrounded by the frame drawn with the dotted line 300 is one pixel, and its configuration is shown in FIG. 3B.

The respective pixels have a source signal line 301, a gate signal line 302, a TFT for switching 303, a memory circuit 304 and an electrophoresis element 305. A gate electrode of the TFT for switching 303 is connected to any one of gate signal lines G1-Gy, and out of the source region and the drain region of the TFT for switching 303, one is connected to any one of source signal lines S1-Sx, the other is connected to the memory circuit 304.

In the circuit shown in FIG. 2, the signals inputted into the source signal lines S1-Sx are inputted into the memory circuit 304 via between the drain and source of TFT for switching 303 which has been in an electrically conductive state by the signal inputted into the gate signal lines G1-Gy in the circuit shown in FIG. 16. The electrophoresis element 305 moves corresponding to the potential of the output of this memory circuit, and the brightness of the respective pixels are represented.

Embodiment 2

Figure 4A:
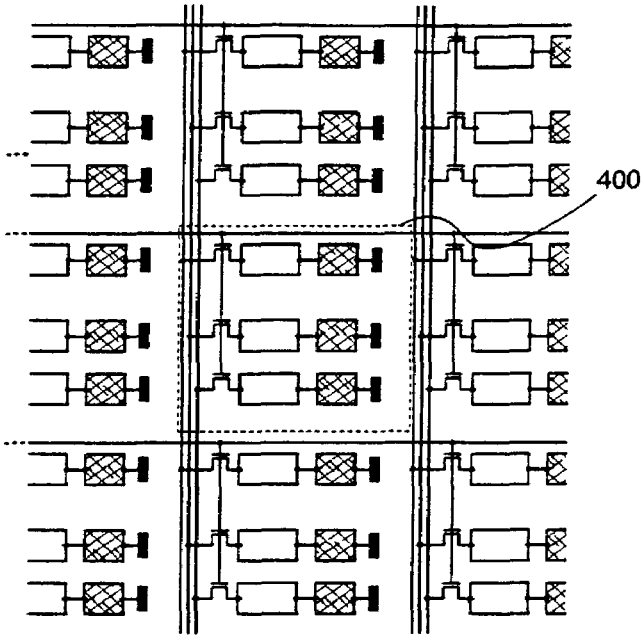
FIGS. 4A and 4B are diagrams showing a configuration example of a pixel corresponding to a 3-bit gradation by utilizing the present invention.
Figure 4B:
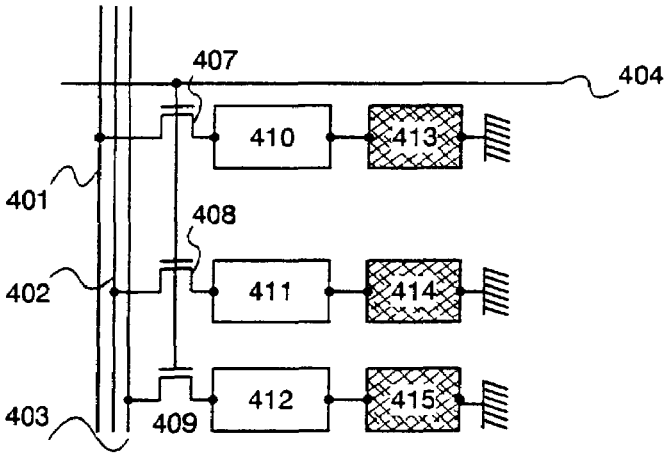

The configuration example of the pixel in the case of 3 bits (8-step gradation) is shown in FIG. 4. As for the pixel shown in FIG. 4, a 3-bit digital picture signal are inputted per each one pixel, the display of $2^3$=8-step gradation is performed. The respective pixels have TFTs for switching 407-409, memory circuits 410-412 and electrophoresis elements 413-415. Each of gate electrodes of the TFTs for switching 407-409 are connected to any one of the gate signal lines G1-Gy, and out of the source region and the drain region of TFTs for switching 407-409, one is connected to any one of the source single lines S1-Sx, and the other is connected to any one of the memory circuits 410-412.

In the respective pixels, the electrophoresis elements are divided into 3 regions whose areas are different from each other, the ratio of the respective areas is set, for example, at 1:2:4, by controlling the respective ones, 8-step linear gradation is capable of being realized. In the case of using colors, $(2^3)^3=512$ colors are capable of being realized. Next, the operation of the pixel in this case will be described below.

Figure 17:
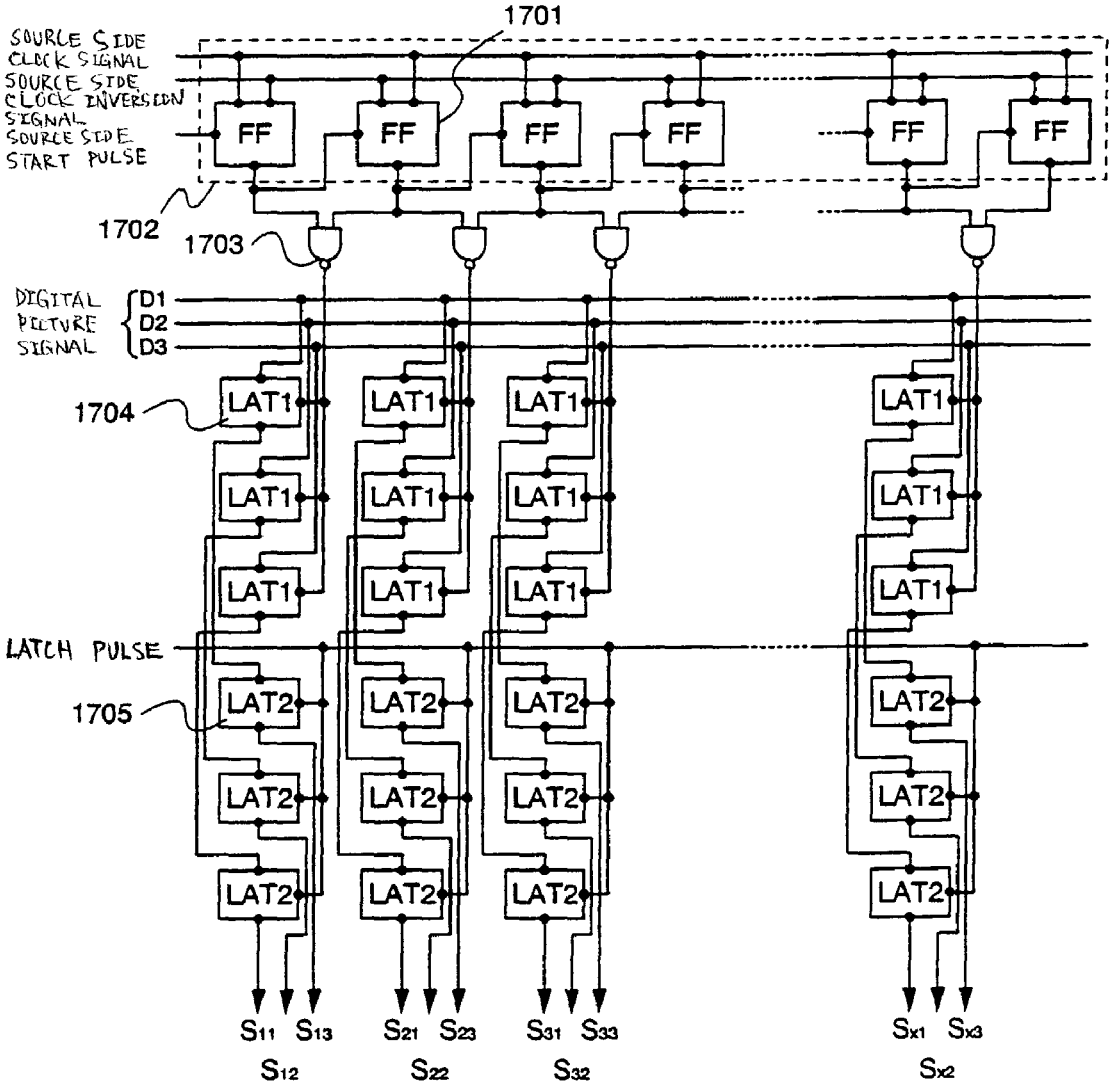
FIG. 17 is a diagram showing a configuration example of a source signal line drive circuit.

The configuration example of the source signal line drive circuit corresponding to the 3-bit digital picture signal is shown in FIG. 17. The source signal line drive circuit shown as an example in FIG. 17 is a source signal line drive circuit corresponding to the display device, which has x pieces of pixels in the horizontal direction, has 3 lines of source signal lines per one piece of pixel and performs the display of $2^3=8$-step gradation by inputting a 3-bit digital picture signal, and has a shift register 1702 comprising utilizing a plurality of rows of flip-flops (FF) 1701, NANDs 1703, first latch circuits (LAT1) 1704, second latch circuits (LAT2) 1705 and the like. The first and second latch circuits are disposed by the portion of 3 bits in parallel and perform the retention of 3-bit digital picture signals (D1-D3). Here, as for the NAND 1703, it may be not particularly provided depending upon the configuration of the shift register 1702. Moreover, although it is not shown in FIG. 17, if necessary, a buffer circuit, a level shifter circuit or the like may be provided.

As for the gate signal line drive circuit, the similar ones shown in FIG. 16 may be available. One gate signal line selection pulse is inputted at the same time with the gate electrodes of TFT 407-409 for switching located within one pixel shown in FIG. 4.

Figure 5:
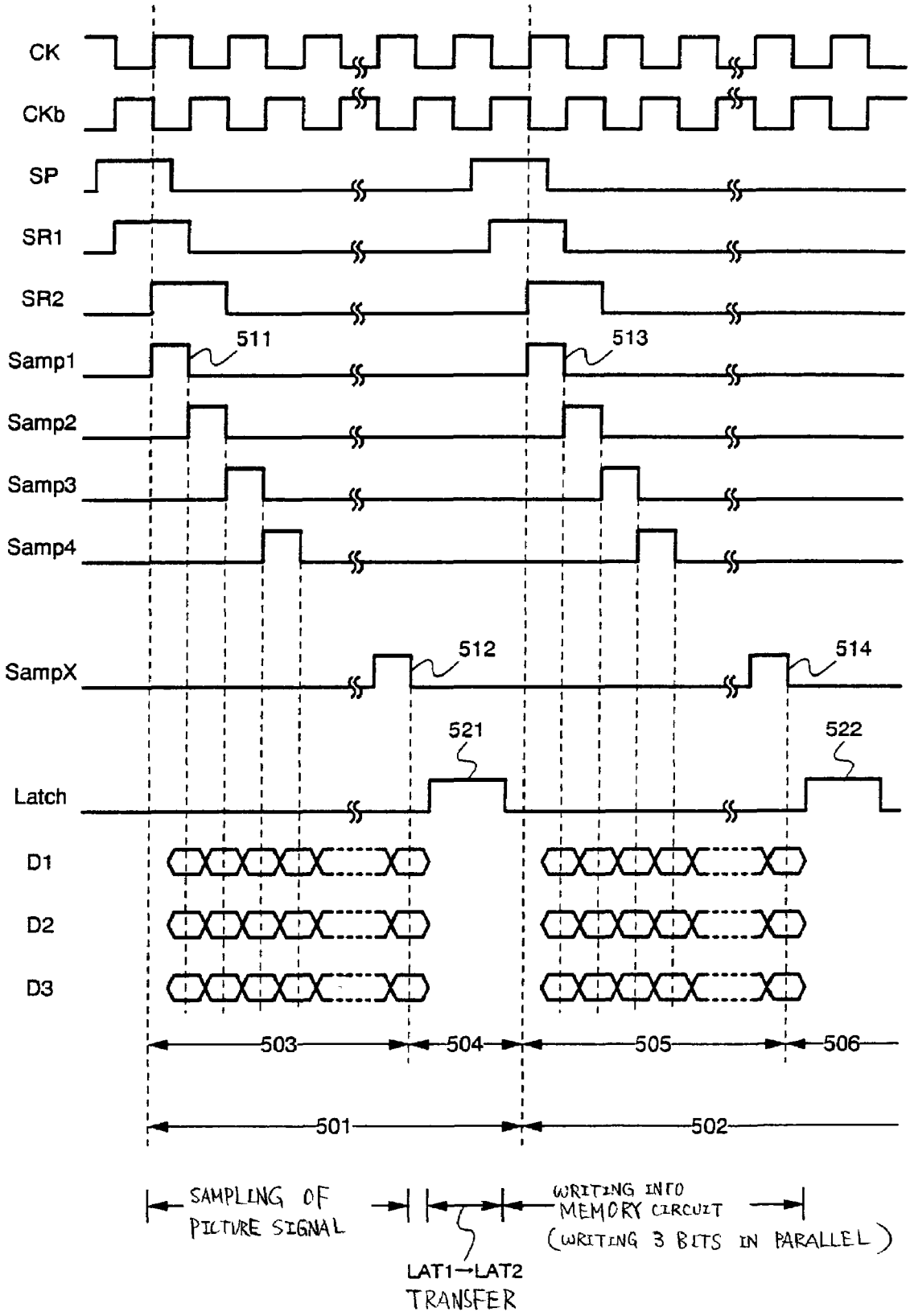
FIG. 5 is a diagram showing a drive timing of an electrophoresis display device having a pixel corresponding to a 3-bit gradation display.

The timing chart shown in FIG. 5 is shown on a source side clock signal (CK), a source side clock inversion signal (CKb), a source side start pulse (SP), shift register outputs (SR1-SR2), sampling pulses (Samp 1-Samp X), a latch pulse (Latch) and digital picture signals (D1-D3). The operation will be described below on the basis of the timing chart.

The next horizontal period is denoted as the reference numeral 502 with respect to a certain horizontal period 501. Each horizontal period has dot sampling periods 503, 505 and horizontal retrace line periods 504. 506. Specifically, the horizontal period is a period from the time when the sampling pulse of the first row is outputted to the time when the sampling pulse of the first row is outputted again, and the dot sampling period is a period from the time when the sampling pulse of the first row is outputted to the time when the sampling pulse of the final row is outputted.

Now, paying attention to a certain horizontal period 501. In the dot sampling period, in accordance with the output of the sampling pulse, a digital picture signal is retained in the first latch circuit. The timing of retention is in accordance with the down edge of the sampling pulse, the portion of 3 bits, that is, a digital picture signal inputted into one pixel is retained at the same time. This operation in turn is carried out from the first row and continues to the final row.

When the retaining operation in the first latch circuit of the final row is terminated, it enters into the horizontal retrace line period. In the horizontal retrace line period, when the latch pulse is inputted (521), the digital picture signals retained in the first latch circuit are all together transferred to the second latch circuit.

Subsequently, when the horizontal retrace line period is terminated, it enters into the next horizontal period 502. In the first latch circuit, similarly the retention of digital picture signal is performed. On the other hand, the digital picture signal retained in the second latch circuit is written into the memory circuit in the pixel section during the dot sampling period 505, precisely during the time until the next latch pulse is inputted. The writing operation into the memory circuit is carried out by the portion of 3 bits at the same time.

EXAMPLES

Hereinafter, examples of the present invention will be described.

Example 1

Figure 6A:
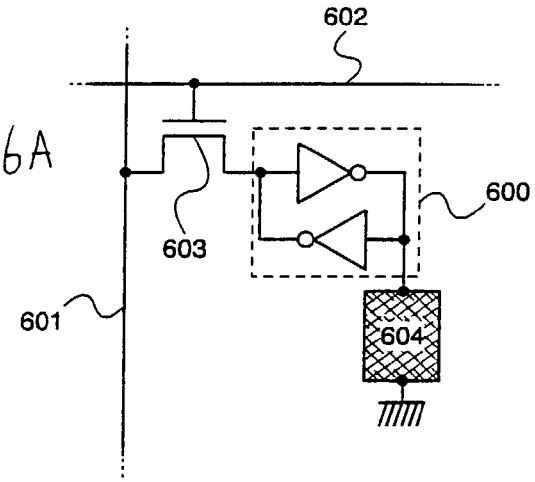
FIGS. 6A and 6B are diagrams showing a configuration example of a pixel using a SRAM for a memory circuit.

FIG. 6A shows an example in which a SRAM is used for pixel. The SRAM is made it hold the retention function by combining the two inverters, it does not require the refresh operation as a DRAM, since once the retention is performed, unless the electrical source is disconnected, the contents are not deleted, and in the case where the picture is not changed, re-write is not required. Hence, in the combination with an electrophoresis display device, the large effect will exert on the reduction of the electric power consumption.

Moreover, here, as a memory circuit, the SRAM configured by combining two inverters has been used, however, as a memory circuit, a nonvolatile memory may be used. In accordance with this, after the electrical source is disconnected, subsequently the display of the static picture is capable of being realized.

Example 2

Figure 6B:
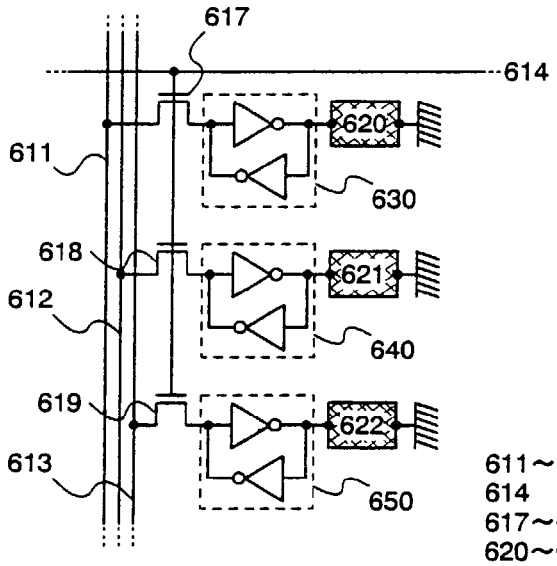

The second Example is shown in FIG. 6B. The pixel of FIG. 6B is a pixel shown in Example 1 in which a SRAM has been used in a memory circuit, and this is an example of pixel configuration in the case of performing the 3-bit gradation representation. The pixels are divided into 3 regions having different areas, and the ratio of the respective areas is set at 1:2:4, then, 8-step gradation is capable of being realized by changing the black and white regions at the ratio of the respective areas. In the case of using colors, $(2^3)^3=512$ colors are capable of being realized.

The configuration of a drive circuit is the same with those shown in FIG. 1 and FIG. 17. Moreover, as for the operation, since it is similar to that described with reference to FIG. 5 in the Embodiment, here, the description is omitted.

Figure 7:
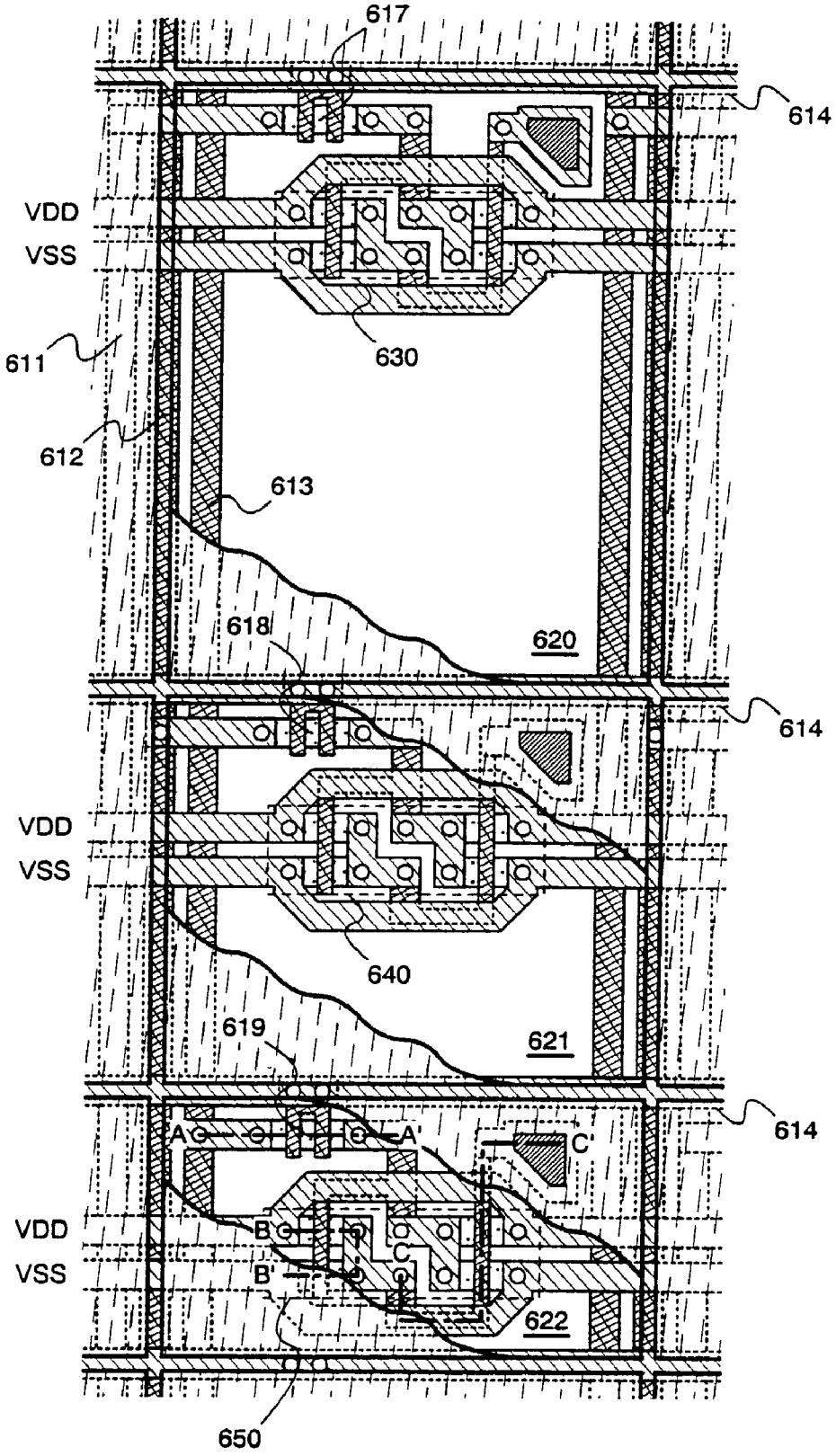
FIG. 7 is a diagram showing a layout example on the substrate of a pixel using a SRAM for a memory circuit.
Figure 9:
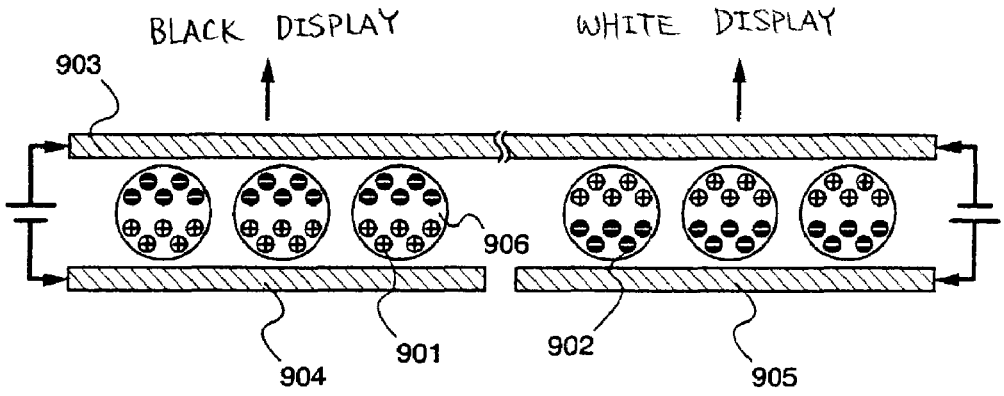
FIG. 9 is a drawing showing a configuration of an electrophoresis element.
Figure 10:
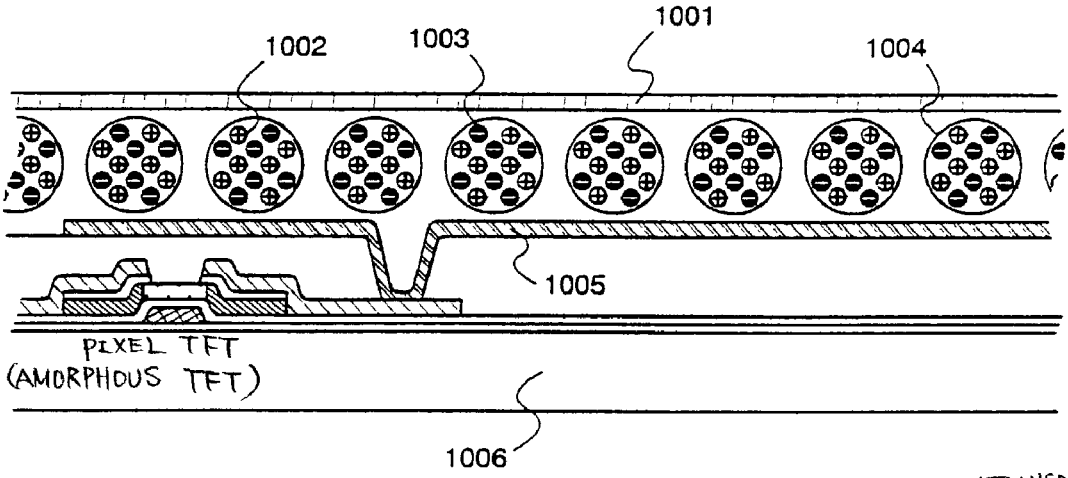
FIG. 10 is a sectional view of a pixel of an electrophoresis display device using the conventional amorphous TFT.
Figure 11:
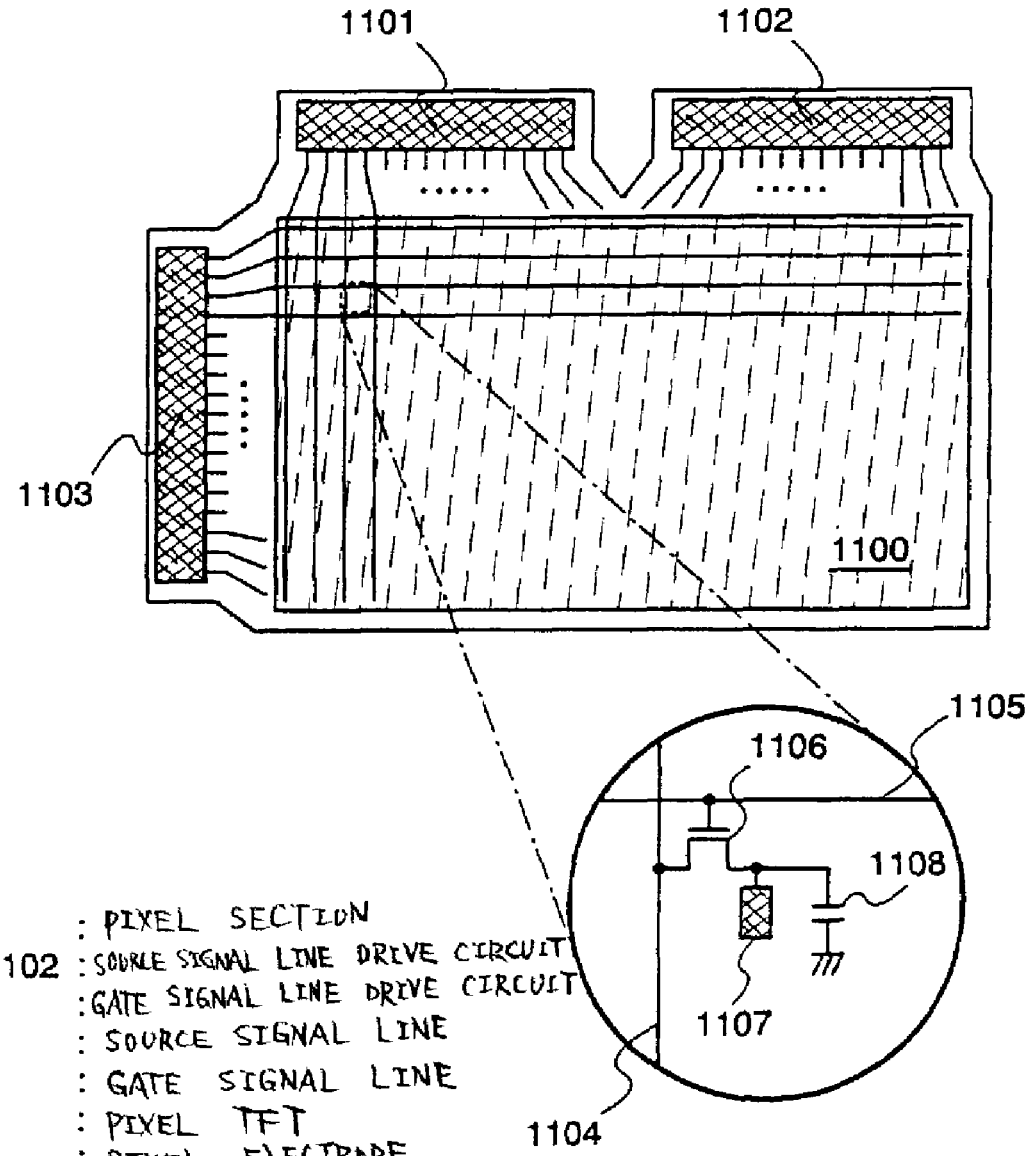
FIG. 11 is a diagram showing a display device using the conventional amorphous TFT.

FIG. 7 shows an example in which the pixel section is laid out in the configuration shown in FIG. 6B. In one pixel, there are 3 pieces of 1-bit SRAMs, the respective SRAMs are connected to TFTs for switching, and further connected to electrophoresis elements. The reference numerals appended in FIG. 7 corresponds to those of FIG. 6B. The electrophoresis elements 620-622 are made their areas of the pixel electrodes divided into the ratio of 1:2:4. To the gate signal lines connected to the TFTs for switching 617-619, the same gate signal line selection pulses are inputted. Hence, the TFTs for switching 617-619 turn ON/OFF at the same time.

The sections shown by lines of A-A', B-B' and C-C' of FIG. 7 are shown in FIG. 8. In the present example, TFTs for switching, SRAMs and the like are consisted of top gate type polysilicon TFT. The reference numerals appended in FIG. 7 correspond to those of FIG. 6B.

Example 3

In Example 1 and Example 2, digital picture signals by the portion of 3 bits are written into pixels in parallel from the respective separate source signal lines, however, if the source signal lines are shared, these are also capable of being in turn written by switching each bit.

Figure 18:
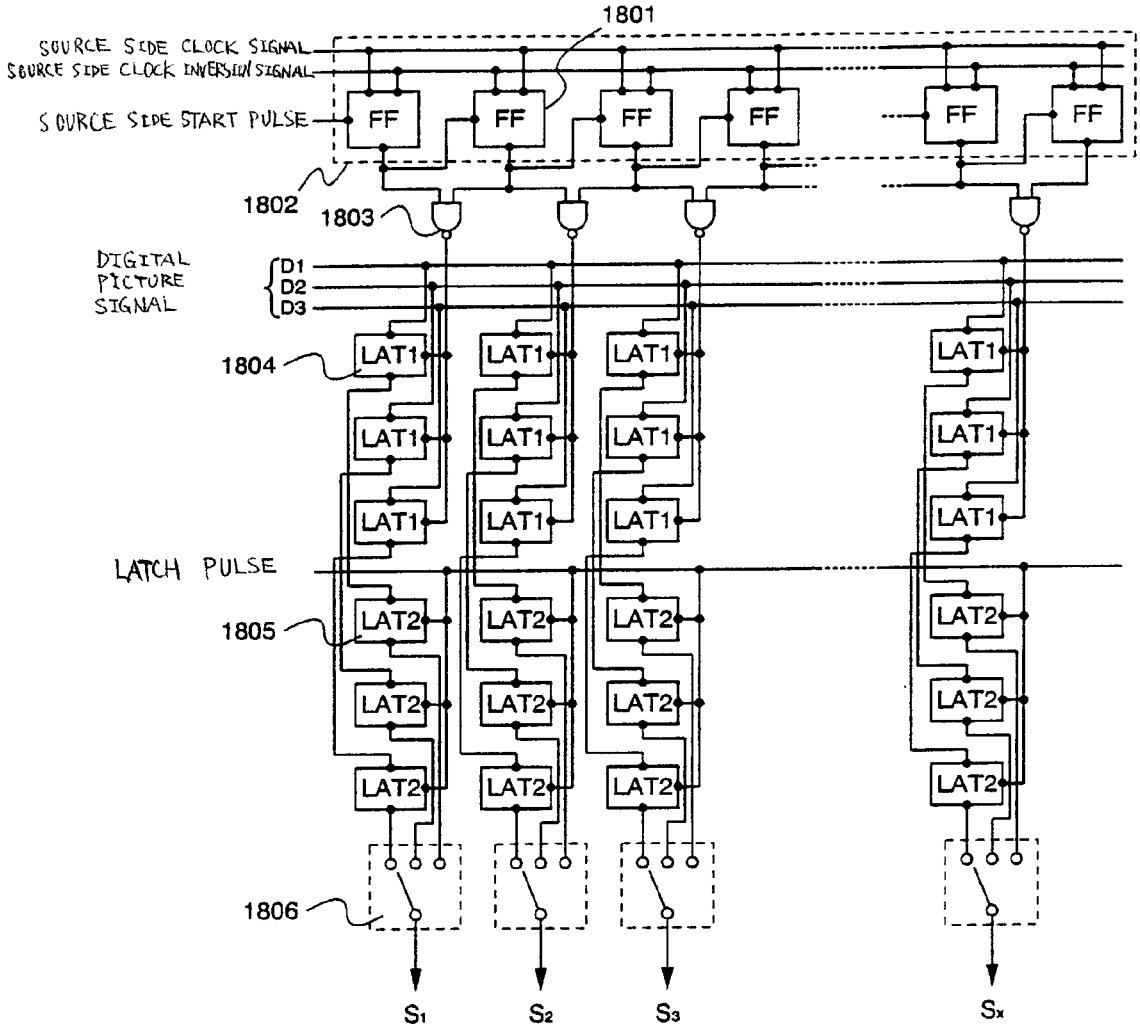
FIG. 18 is a diagram showing a configuration example of a source signal line drive circuit.

The configuration example of a source signal line drive circuit in the case where such a writing is carried out is shown in FIG. 18. As for the configuration of a shift register 1802—a second latch circuit 1805, it is similar to that shown in FIG. 17.

Here, in order to write a 3-bit digital picture signal in a memory circuit within a pixel via a single source signal line, a selection switch 1806 is provided between the output of the second latch circuit 1805 and the source signal line. Until the second latch circuit 1805, as for the 3-bit digital picture signal, each bit has been processed in parallel, however, the inputs into the source signal lines are in turn carried out by the selection switch. The order may be appropriately set by the person who practices it.

Figure 19:
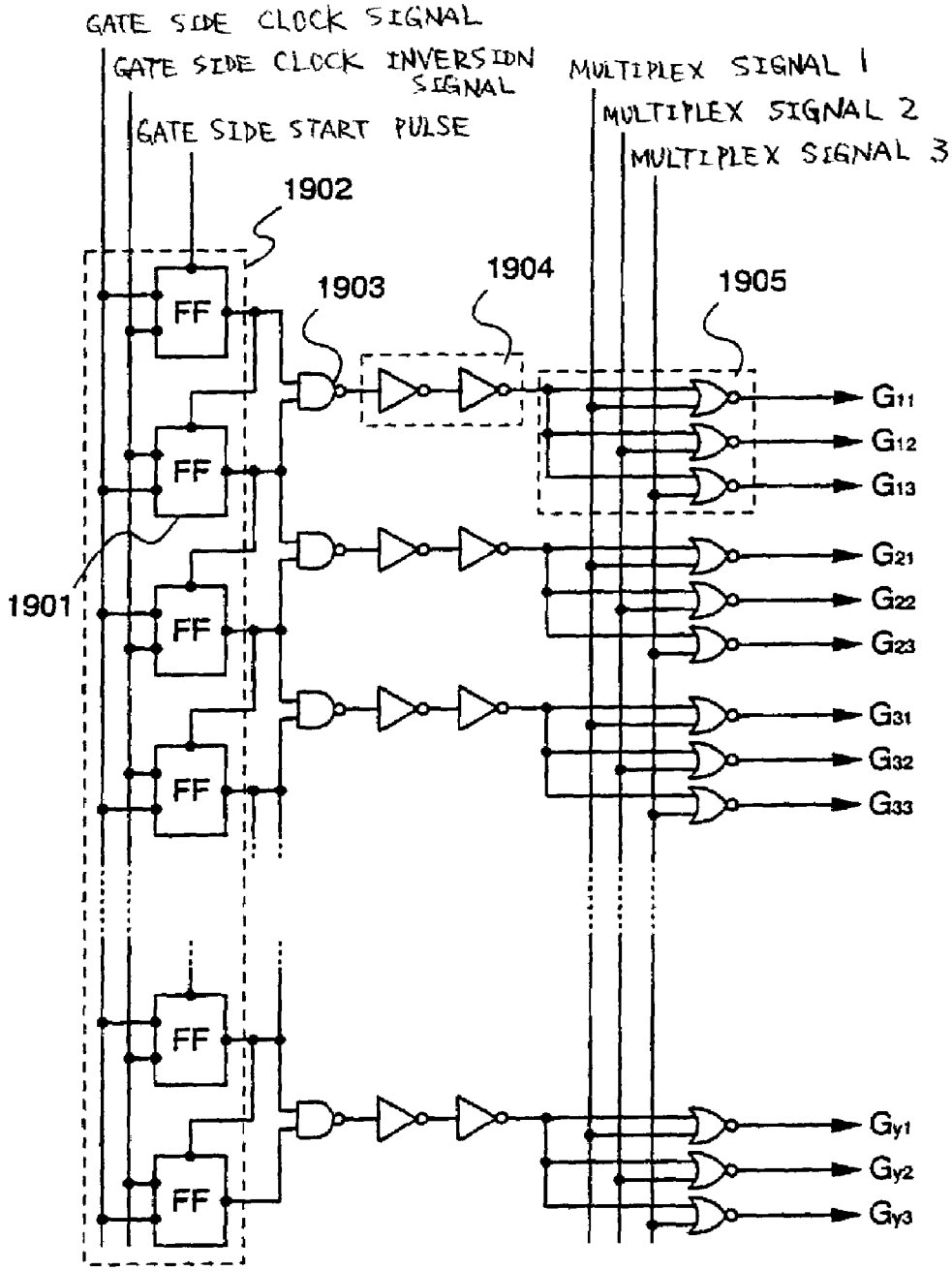
FIG. 19 is a diagram showing a configuration example of a gate signal line drive circuit.
Figure 20A:
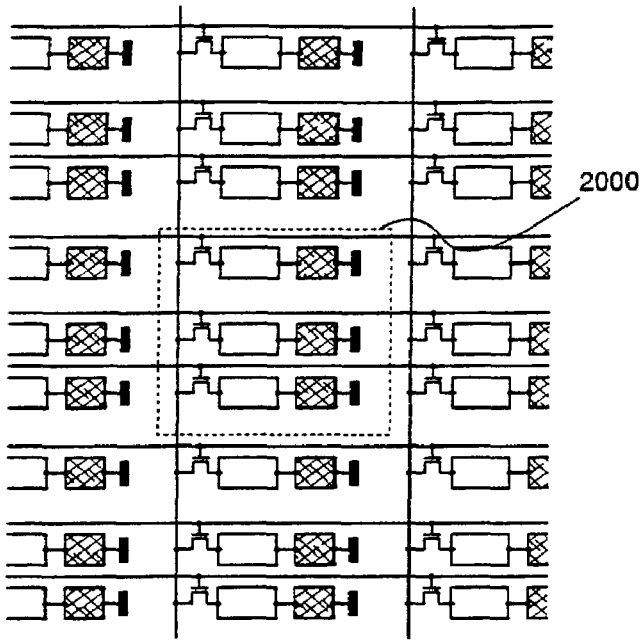
FIGS. 20A and 20B are diagrams showing a configuration example of a pixel of the present invention.
Figure 20B:
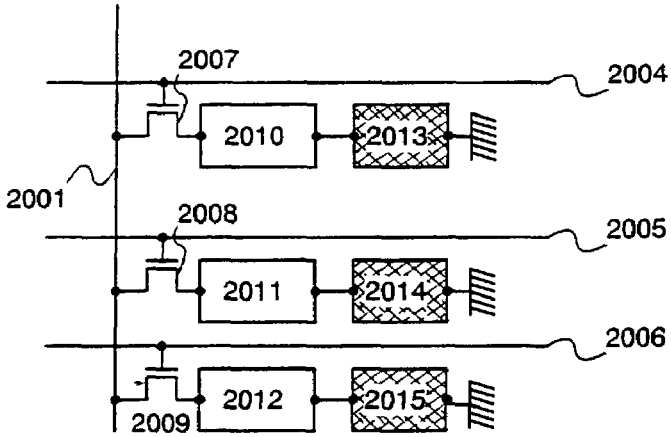

FIG. 19 shows the configuration example of a gate signal line drive circuit used in the present Example. As for the configuration of a shift register 1902—a buffer 1904, it may be available if it is similar to that shown in FIG. 16.

Although the buffer 1604 of FIG. 16 and the buffer 1904 of FIG. 19 are different in the number of rows, the number of rows may be set for differentiating whether the buffer output is obtained at H level or at L level, here, the number of rows or the like is no object.

In Example 1 and Example 2, one gate signal line selection pulse has driven the 3 pieces of TFTs for switching within one pixel at the same time, thereby digital picture signals by the portion of 3 bits have been written at the same time, however, in the present Example, after the buffer 1904 is outputted, one horizontal period is divided into a plurality of sub-periods using a multiplexer 1905. This number to be divided is equal to the number of bits of a digital picture signal, in the present Example, it was divided into 3 sub-periods. The switching timing of the selection switch provided in the source signal line drive circuit and the divided timing of the horizontal period by the multiplexer are synchronized, in each sub-period, the writings of the respective bit digital picture signals are carried out.

Figure 21:
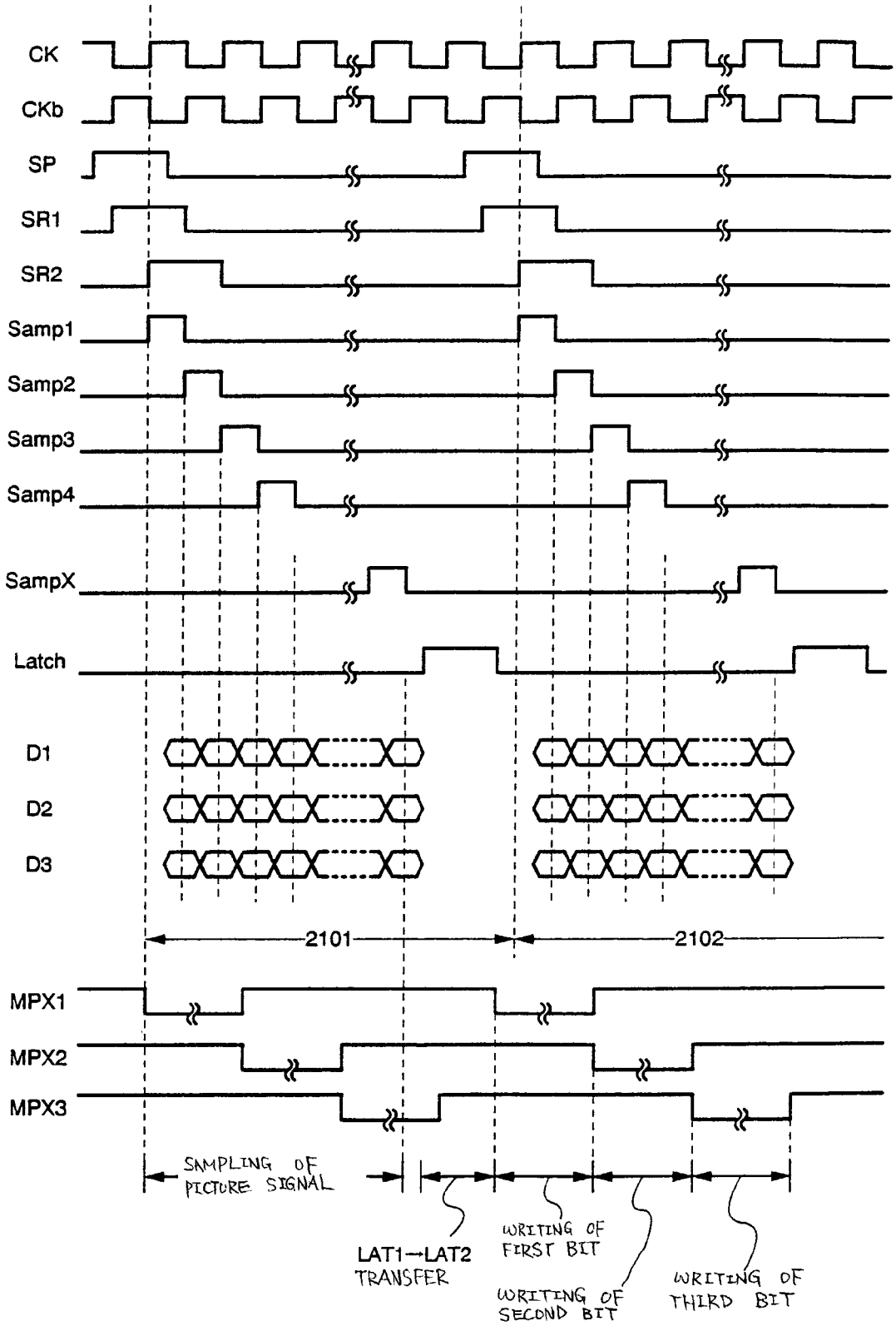
FIG. 21 is a diagram showing a drive timing of an electrophoresis display device having a pixel corresponding to a 3-bit gradation display.

The timing chart is shown in FIG. 21. The sampling and latch operation of a digital picture signal is similar to those of Example 1 and Example 2. The digital picture signal sampled and retained in a certain horizontal period 2101 is transferred to the second latch circuit during the period of retrace line. Subsequently, in the next horizontal period 2102, during the period that the sampling operation of the digital picture signal of the next line is carried out, a digital picture signal is outputted from the second latch circuit to the source signal line, and written in a memory circuit within a pixel. At this time, by multiplex signals (MPX1-3), the write period into the pixel is divided, the respective-bit digital picture signals are in turn written in the memory circuit within the pixel. It should be noted that the timing at which a selection switch in the source signal line drive circuit selects the source signal line is also synchronized with the multiplex signal.

Example 4

In Example 4, a method of simultaneously manufacturing TFTs of a pixel portion of an electrophoresis display device of the present invention and driver circuit portions provided in the periphery thereof is described. However, in order to simplify the explanation, a CMOS circuit, which is the basic circuit for the driver circuit, is shown in the figures.

For the pixel portion, only a source signal wiring, TFTs for switching and the connection portion of pixel electrodes are denoted. For the memory circuit, in a case of using SRAM, is not denoted particularly due to the same constitution as the CMOS circuit of the driver circuit.

First, as shown in FIG. 12A, a base film 5002 made of an insulating film such as a silicon oxide film, a silicon nitride film, or a silicon oxynitride film is formed on a substrate 5001 made of glass such as barium borosilicate glass or alumino borosilicate glass, typified by #7059 glass or #1737 glass of Corning Inc. For example, a silicon oxynitride film 5002*a* fabricated from $SiH_4$, $NH_3$ and $N_2O$ by a plasma CVD method is formed with a thickness of 10 to 200 nm (preferably 50 to 100 nm), and a hydrogenated silicon oxynitride film 5002*b* similarly fabricated from $SiH_4$ and $N_2O$ is formed with a thickness of 50 to 200 nm (preferably 100 to 150 nm) to form a lamination. In Example 4, although the base film 5002 is shown as the two-layer structure, the film may be formed of a single layer film of the foregoing insulating film or as a lamination structure of more than two layers.

Island-like semiconductor films 5003 to 5005 are formed of a crystalline semiconductor film manufactured by using a laser crystallization method on a semiconductor film having an amorphous structure, or by using a known thermal crystallization method. The thickness of the island-like semiconductor films 5003 to 5005 is set from 25 to 80 nm (preferably between 30 and 60 nm). There is no limitation on the crystalline semiconductor film material, but it is preferable to form the film from a silicon or a silicon germanium (SiGe) alloy.

A laser such as a pulse oscillation type or continuous emission type excimer laser, a YAG laser, or a $YVO_4$ laser is used for manufacturing the crystalline semiconductor film in the laser crystallization method. A method of condensing laser light emitted from a laser oscillator into a linear shape by an optical system and then irradiating the light to the semiconductor film may be employed when these types of lasers are used. The crystallization conditions may be suitably selected by the operator, but the pulse oscillation frequency is set to 30 Hz, and the laser energy density is set from 100 to 400 mJ/cm$^2$ (typically between 200 and 300 mJ/cm$^2$) when using the excimer laser. Further, the second harmonic is utilized when using the YAG laser, the pulse oscillation frequency is set from 1 to 10 kHz, and the laser energy density may be set from 300 to 600 mJ/cm$^2$ (typically between 350 and 500 mJ/cm$^2$) The laser light which has been condensed into a linear shape with a width of 100 to 1000 μm, for example 400 μm, is then irradiated over the entire surface of the substrate. This is performed with an overlap ratio of 80 to 98% in case of the linear laser.

Next, a gate insulating film 5006 is formed covering the island-like semiconductor layers 5003 to 5005. The gate insulating film 5006 is formed of an insulating film containing silicon with a thickness of 40 to 150 nm by a plasma CVD method or a sputtering method. A 120 nm thick silicon oxynitride film is formed in Example 4. The gate insulating film 5006 is not limited to such a silicon oxynitride film, of course, and other insulating films containing silicon may also be used, in a single layer or in a lamination structure. For example, when using a silicon oxide film, it can be formed by the plasma CVD method with a mixture of TEOS (tetraethyl orthosilicate) and $O_2$, at a reaction pressure of 40 Pa, with the substrate temperature set from 300 to 400° C., and by discharging at a high frequency (13.56 MHz) with electric power density of 0.5 to 0.8 W/cm$^2$. Good characteristics of the silicon oxide film thus manufactured as a gate insulating film can be obtained by subsequently performing thermal annealing at 400 to 500° C.

A first conductive film 5007 and a second conductive film 5008 are then formed on the gate insulating film 5006 in order to form gate electrodes. In Example 4, the first conductive film 5007 is formed from Ta with a thickness of 50 to 100 nm, and the second conductive film 5008 is formed from W with a thickness of 100 to 300 nm.

The Ta film is formed by sputtering, and sputtering of a Ta target is performed by using Ar. If an appropriate amount of Xe or Kr is added to the Ar during sputtering, the internal stress of the Ta film will be relaxed, and film peeling can be prevented. The resistivity of an α phase Ta film is on the order of 20 μΩcm, and the Ta film can be used for the gate electrode, but the resistivity of a β phase Ta film is on the order of 180 μΩcm and the Ta film is unsuitable for the gate electrode. The α phase Ta film can easily be obtained if a tantalum nitride film, which possesses a crystal structure near that of phase Ta, is formed with a thickness of 10 to 50 nm as a base for Ta in order to form the phase Ta film.

The W film is formed by sputtering with W as a target. The W film can also be formed by a thermal CVD method using tungsten hexafluoride ($WF_6$). Whichever is used, it is necessary to make the film low resistant in order to use it as the gate electrode, and it is preferable that the resistivity of the W film be set 20 μΩcm or less. The resistivity can be lowered by enlarging the crystals of the W film, but for cases where there are many impurity elements such as oxygen within the W film, crystallization is inhibited, and the film becomes high resistant. A W target having a purity of 99.9999% is thus used in sputtering. In addition, by forming the W film while taking sufficient care such that no impurities from the inside of the gas phase are introduced at the time of film formation, a resistivity of 9 to 20 μΩcm can be achieved.

Note that although the first conductive film 5007 and the second conductive film 5008 are formed from Ta and W, respectively, in Example 4, the conductive films are not limited to these. Both the first conductive film 5007 and the second conductive film 5008 may also be formed from an element selected from a group consisting of Ta, W, Ti, Mo, Al, and Cu, or from an alloy material or a chemical compound material having one of these elements as its main constituent. Further, a semiconductor film, typically a polysilicon film, into which an impurity element such as phosphorus is doped, may also be used. Examples of preferable combinations other than that in Example 4 include: the first conductive film 5007 formed from tantalum nitride (TaN) and the second conductive film 5008 formed from W; the first conductive film 5007 formed from tantalum nitride (TaN) and the second conductive film 5008 formed from Al; and the first conductive film 5007 formed from tantalum nitride (TaN) and the second conductive film 5008 formed from Cu.

Moreover, in case of that LDD (Lightly Doped Drain) region can be made smaller, the constitution of W can be a single layer, even in the same constitution, the length of LDD can be made smaller by standing a taper angle.

Next, a mask 5009 is formed from resist, and a first etching process is performed in order to form electrodes and wirings. An ICP (inductively coupled plasma) etching method is used in Example 4. A gas mixture of $CF_4$ and $Cl_2$ is used as an etching gas, and a plasma is generated by applying a 500 W RF electric power (13.56 MHz) to a coil shape electrode at 1 Pa. A 100 W RF electric power (13.56 MHz) is also applied to the substrate side (test piece stage), effectively applying a negative self-bias voltage. The W film and the Ta film are both etched on the same order when $CF_4$ and $Cl_2$ are mixed.

Edge portions of the first conductive layer and the second conductive layer are made into a tapered shape in accordance with the effect of the bias voltage applied to the substrate side with the above etching conditions by using a suitable resist mask shape. The angle of the tapered portions is from 15 to 45°. The etching time may be increased by approximately 10 to 20% in order to perform etching without any residue on the gate insulating film. The selectivity of a silicon oxynitride film with respect to a W film is from 2 to 4 (typically 3), and therefore approximately 20 to 50 nm of the exposed surface of the silicon oxynitride film is etched by this over-etching process. First shape conductive layers 5010 to 5013 (first conductive layers 5010*a* to 5013*a* and second conductive layers 5010*b* to 5013*b*) are thus formed of the first conductive layer and the second conductive layer by the first etching process. At this point, regions of the gate insulating film 5006 not covered by the first shape conductive layers 5010 to 5013 are made thinner by approximately 20 to 50 nm by etching.

Then, a first doping process is performed to add an impurity element for imparting a n-type conductivity. Doping may be carried out by an ion doping method or an ion implanting method. The condition of the ion doping method is that a dosage is $1\times10^{13}$ to $5\times10^{14}$ atoms/cm$^2$, and an acceleration voltage is 60 to 100 keV. As the impurity element for imparting the n-type conductivity, an element belonging to group 15, typically phosphorus (P) or arsenic (As) is used, but phosphorus is used here. In this case, the conductive layers 5010 to 5013 become masks to the impurity element to impart the n-type conductivity, and first impurity regions 5014 to 5016 are formed in a self-aligning manner. The impurity element to impart the n-type conductivity in the concentration range of $1\times10^{20}$ to $1\times10^{21}$ atoms/cm$^3$ is added to the first impurity regions 5014 to 5016. (FIG. 12B)

Next, as shown in FIG. 12C, a second etching process is performed without removing the mask formed from resist. The etching gas of the mixture of $CF_4$, $Cl_2$ and $O_2$ is used, and the W film is selectively etched. At this point, second shape conductive layers 5017 to 5020 (first conductive layers 5017*a* to 5020*a* and second conductive layers 5017*b* to 5020*b*) are formed by the second etching process. Regions of the gate insulating film 5006, which are not covered with the second shape conductive layers 5017 to 5020 are made thinner by about 20 to 50 nm by etching.

An etching reaction of the W film or the Ta film by the mixture gas of $CF_4$ and $Cl_2$ can be guessed from a generated radical or ion species and the vapor pressure of a reaction product. When the vapor pressures of fluoride and chloride of W and Ta are compared with each other, the vapor pressure of $WF_6$ of fluoride of W is extremely high, and other $WCl_5$, $TaF_5$, and $TaCl_5$ have almost equal vapor pressures. Thus, in the mixture gas of $CF_4$ and $Cl_2$, both the W film and the Ta film are etched. However, when a suitable amount of $O_2$ is added to this mixture gas, $CF_4$ and $O_2$ react with each other to form CO and F, and a large number of F radicals or F ions are generated. As a result, an etching rate of the W film having the high vapor pressure of fluoride is increased. On the other hand, with respect to Ta, even if F is increased, an increase of the etching rate is relatively small. Besides, since Ta is easily oxidized as compared with W, the surface of Ta is oxidized by addition of $O_2$. Since the oxide of Ta does not react with fluorine or chlorine, the etching rate of the Ta film is further decreased. Accordingly, it becomes possible to make a difference between the etching rates of the W film and the Ta film, and it becomes possible to make the etching rate of the W film higher than that of the Ta film.

Then, a second doping process is performed. In this case, a dosage is made lower than that of the first doping process and under the condition of a high acceleration voltage, an impurity element for imparting the n-type conductivity is doped. For example, the process is carried out with an acceleration voltage set to 70 to 120 keV and at a dosage of $1\times10^{13}$ atoms/cm$^2$, so that new impurity regions are formed inside of the first impurity regions formed into the island-like semiconductor layers in FIG. 12B. Doping is carried out such that the second shape conductive layers 5017 to 5020 are used as masks to the impurity element and the impurity element is added also to the regions under the first conductive layers 5017*a* to 5020*a*. In this way, second impurity regions 5021 to 5023 are formed. The concentration of phosphorus (P) added to the second impurity regions 5021 to 5023 have a gentle concentration gradient in accordance with the thickness of tapered portions of the first conductive layers 5017*a* to 5020*a*. Note that in the semiconductor layer that overlap with the tapered portions of the first conductive layers 5017*a* to 5020*a*, the concentration of impurity element slightly falls from the end portions of the tapered portions of the first conductive layers 5017*a* to 5020*a* toward the inner portions, but the concentration keeps almost the same level. (FIG. 12C)

As shown in FIG. 12D, a third etching process is performed. This is performed by using a reactive ion etching method (RIE method) with an etching gas of $CHF_6$. The tapered portions of the first conductive layers 5017*a* to 5020*a* are partially etched, and the region in which the first conductive layers overlap with the semiconductor layer is reduced by the third etching process. Third shape conductive layers 5024 to 5027 (first conductive layers 5024*a* to 5027*a* and second conductive layers 5024*b* to 5027*b*) are formed. At this point, regions of the gate insulating film 5006, which are not covered with the third shape conductive layers 5024 to 5027 are made thinner by about 20 to 50 nm by etching.

By the third etching process, a part of second impurity regions 5021 to 5023, that is to say, a region where the second impurity regions 5021 to 5023 are not overlapped with the first conductive layers 5024*a* to 5027*a*, third impurity regions 5028 to 5030 are formed thereon. (FIG. 12D)

Then, as shown in FIG. 13A, a resist mask 5031 is formed newly, a fourth impurity region 5032 having a conductivity type opposite to the first conductivity type are formed in the island-like semiconductor layer 5004 for forming P-channel TFTs. The first conductive layer 5025*b* is used as masks to an impurity element, and the impurity region is formed in a self-aligning manner. At this time, in the impurity region 5032, Phosphorus is partly added to the impurity region 5032 at different concentrations, respectively, however, p-type conductivity can be imparted by raising the amount of dose of diborane ($B_2H_6$) much enough than that of phosphorus. Incidentally, in the impurity region 5032, the impurity concentration is made $2\times10^{20}$ to $2\times10^{21}$ atoms/cm$^3$ in any of the regions.

By the steps up to this, the impurity regions are formed in the respective island-like semiconductor layers. The third shape conductive layers 5024, 5025 and 5027 overlapping with the island-like semiconductor layers function as gate electrodes. The conductive layer 5026 functions as a source signal line.

After the resist mask 5031 is removed, a step of activating the impurity elements added in the respective island-like semiconductor layers for the purpose of controlling the conductivity type. This step is carried out by a thermal annealing method using a furnace annealing oven. In addition, a laser annealing method or a rapid thermal annealing method (RTA method) can be applied. The thermal annealing method is performed in a nitrogen atmosphere having an oxygen concentration of 1 ppm or less, preferably 0.1 ppm or less and at 400 to 700° C., typically 500 to 600° C. In Example 4, a heat treatment is conducted at 500° C. for 4 hours. However, in the case where a wiring material used for the third conductive layers 5024 to 5027 is weak against heat, it is preferable that the activation is performed after an interlayer insulating film (containing silicon as its main ingredient) is formed to protect the wiring line or the like.

Further, a heat treatment at 300 to 450° C. for 1 to 12 hours is conducted in an atmosphere containing hydrogen of 3 to 100%, and a step of hydrogenating the island-like semiconductor layers is conducted. This step is a step of terminating dangling bonds in the semiconductor layer by thermally excited hydrogen. As another means for hydrogenation, plasma hydrogenation (using hydrogen excited by plasma) may be carried out.

Next, as shown in FIG. 13B, a first interlayer insulating film 5033 having a thickness of 100 to 200 nm is formed of a silicon oxynitride film. A second interlayer insulating film 5034 made of an organic insulator material is formed thereon. The second interlayer insulating film also has a purpose to sufficiently flatten the surface of the substrate. Subsequently, an etching process is conducted to form a contact hole.

Then, wirings 5035 to 5039 and a gate signal line 5040 are formed.

In Example 4, though the writing TFT is shown as a double gate structure, a single gate structure, a triple gate structure or even a multi gate structure can also be used.

As described above, the driving circuit portion having the n-channel type TFT and the p-channel type TFT and the pixel portion having the writing TFT and the storage capacitor (capacitor element) can be formed on one substrate. Such a substrate is referred to as an active matrix substrate in this specification.

Further, according to the process described in Example 4, the number of photomasks necessary for manufacturing an active matrix substrate can be set to five (a pattern for the island-like semiconductor layers, a pattern for the first wirings (source signal lines and capacitor wirings), a mask pattern for the p-channel regions, a pattern for the contact holes, and a pattern for the second wirings (including the pixel electrodes and the connecting electrodes)). As a result, the process can be made shorter, the manufacturing cost can be lowered, and the yield can be improved.

Subsequently, a third interlayer insulting film 5041 is formed, and a contact hole is formed thereafter. Further, pixel electrodes are formed by patterning in the pixel portion.

Subsequently, a microcapsule 5043 which enclosed transparent liquid and charged particles is applied on the pixel electrodes. As above-mentioned, since the microcapsule 5043 is generally approximately 80 μm, a printing method or the like of the application can be conducted, and the application of the microcapsule is conducted only to the position of request of the pixel portion.

Further, a counter electrode 5044 consisted from transparent conductive film is formed. The material for the conductive film typified by ITO (Indium Tin Oxide) or the like can be used.

Finally, a protective film 5045 is formed to protect the surface, then, an active matrix electrophoresis display device as shown in FIG. 13C is completed. Incidentally, the protective film shown in FIG. 13C is formed on entire of the substrate, however, the protective film can be formed only in the pixel portion, or on the entire of the substrate except on FPCs.

Incidentally, TFT in the active matrix type electro optical device formed by the above mentioned steps has a top gate structure, but this example can be easily applied to bottom gate structure TFT and dual gate structure TFT and other structure TFT.

Further, though the glass substrate is used in Example 4, there is no limitation on it. Other than glass substrate, such as a plastic substrate, a stainless substrate and single crystalline wafers can be used to implement. Flexibility can be given to the display device itself by using the substrate which is rich in elasticity.

Example 4 can be conducted by freely combining Examples 1 to 3.

Example 5

The electrophoresis display device of the present invention has various usages. In Example 5, the electronic apparatuses applied the electrophoresis display device of the present invention are described as examples.

The following can be given as examples of such electronic apparatus: a portable information terminal (such as an electronic book, a mobile computer, or a mobile phone); a video camera; a digital camera; a personal computer and a television. Examples of those apparatus are shown in FIGS. 14 and 15.

Figure 14A:
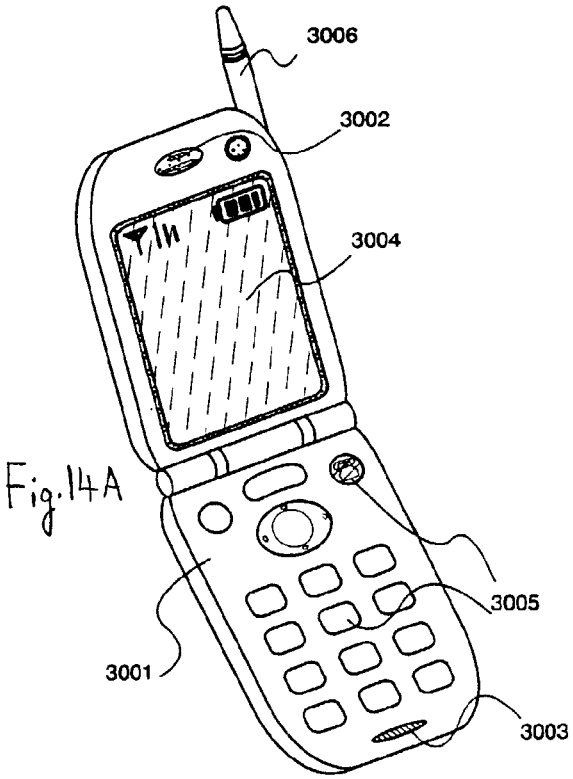
FIGS. 14A, 14B, 14C and 14D are drawings showing applied devices of display devices according to the present invention.

FIG. 14A is a mobile phone which includes a main body 3001, a voice output portion 3002, a voice input portion 3003, a display portion 3004, operation switches 3005, and an antenna 3006. The present invention can be applied to the display portion 3004.

Figure 14B:
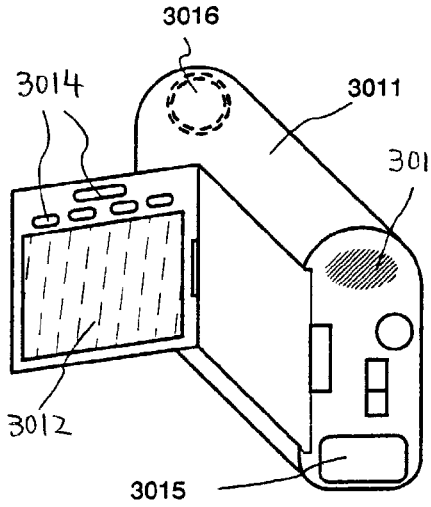

FIG. 14B illustrates a video camera which includes a main body 3011, a display portion 3012, an audio input portion 3013, operation switches 3014, a battery 3015, an image receiving portion 3016, or the like. The present invention can be applied to the display portion 3012.

Figure 14C:
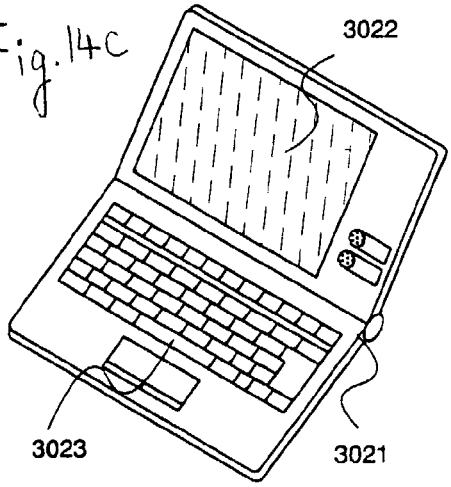

FIG. 14C illustrates a personal computer which includes a main body 3021, a display portion 3022 and a key board 3023, or the like. The present invention can be applied to the display portion 3022.

Figure 14D:
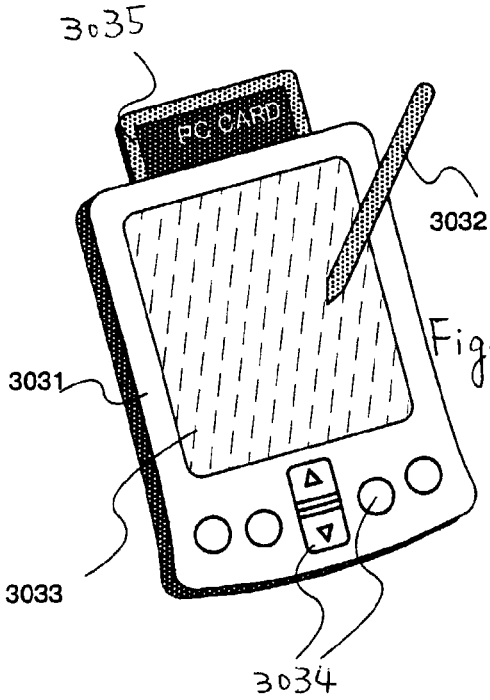

FIG. 14D illustrates a portable information terminal which includes a main body 3031, a stylus pen 3032, a display portion 3033, a switching bottom 3034 and an external interface 3035. The present invention can be applied to the display portion 3033.

Figure 15A:
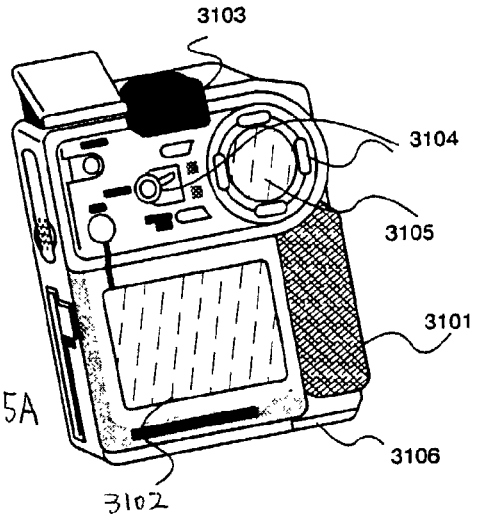
FIGS. 15A, 15B, 15C and 15D are drawings showing applied devices of display devices according to the present invention.

FIG. 15A illustrates a digital camera which includes a main body 3101, a display portion A 3102, an eyepiece portion 3103, operation switches 3104, a display portion B 3105, an image receiving section (not shown in the figure), and a battery 3106. The present invention can be applied to the display portion A 3102 and display portion B 3105.

Figure 15B:
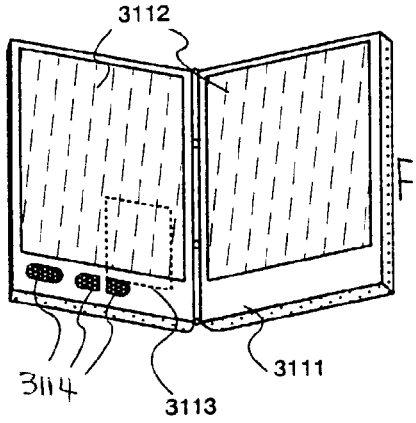

FIG. 15B illustrates a portable electronic book which includes a main body 3111, a display portion 3112, a memory medium 3113, and an operation switch 3114 and the portable electronic book displays a data recorded in mini disc (MD) and DVD (Digital Versatile Disc) and a data receiving from outside. The present invention can be applied to the display portion 3112.

Figure 15C:
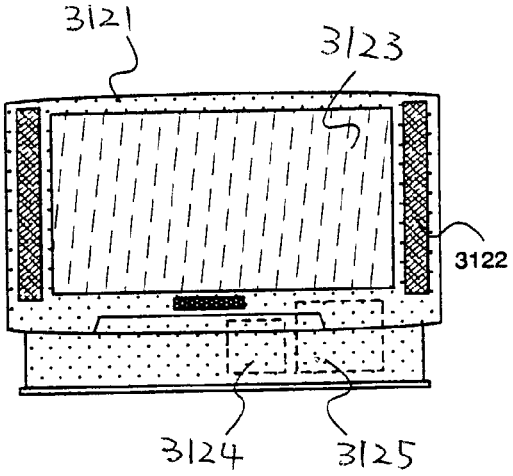

FIG. 15C illustrates a television which includes a main body 3121, a speaker 3122, a display portion 3123, an receiving device 3124 and an amplifier device 3125. The present invention can be applied to the display portion 3123.

Figure 15D:
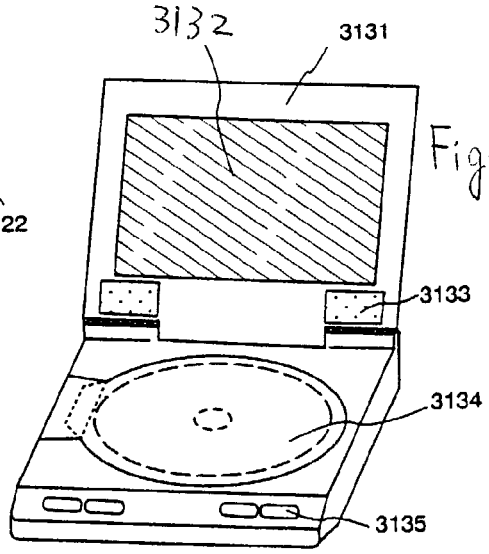

FIG. 15D illustrates a player using a recording medium which records a program and includes a main body 3131, a display portion 3132, a speaker section 3133, a recording medium 3134, and operation switches 3135. This player uses DVD (digital versatile disc), CD, etc. for the recording medium, and can be used for music appreciation, film appreciation, games and Internet. The present invention can be applied to the display portion 3132.

In the conventional electrophoresis display device, the drive circuit is externally mounted in the form of IC chip or the like, there have been problems from the viewpoints of cost, reliability or the like. Moreover, since a pixel had the retention capacitance similar to the liquid crystal and has been configured by the combination of TFTs for switching, a periodical refresh is required and the power consumption has been increased.

In the present invention, the reduction of cost and the enhancement of the reliability are contemplated by integrally forming a pixel and a drive circuit as described above, and the number of writings and the power consumption are capable of being reduced by embedding a memory circuit into a pixel.

What is claimed is:

1. An electrophoresis display device comprising:

a source signal line, and a pixel region including at least a first sub pixel, a second sub pixel, and a third sub pixel, the first sub pixel comprising: a first pixel electrode, a first thin film transistor, a first plurality of microcapsules and a first SRAM connected between the first pixel electrode and the first thin film transistor;

the second sub pixel comprising: a second pixel electrode, a second thin film transistor, a second plurality of microcapsules and a second SRAM connected between the second pixel electrode and the second thin film transistor, the third sub pixel comprising: a third pixel electrode, a third thin film transistor, a third plurality of microcapsules and a third SRAM connected between the third pixel electrode and the third thin film transistor, wherein the first sub pixel, the second sub pixel, and the third sub pixel share the source signal line, wherein the first plurality of microcapsules are provided adjacent to the first pixel electrode, and a plurality of charged particles are embedded in the first plurality of microcapsules, wherein areas of the at least first sub pixel, second sub pixel, and third sub pixel are different from each other, wherein the first SRAM comprises a fourth thin film transistor and a fifth thin film transistor, and wherein the first pixel electrode is covering all of the first thin film transistor, the fourth thin film transistor and the fifth thin film transistor, and the first plurality of microcapsules are over the first pixel electrode, and all of the first thin film transistor, the fourth thin film transistor and the fifth thin film transistor.

2. A device according to claim 1 wherein said electrophoresis display device is incorporated into an electronic apparatus.

3. A device according to claim 1 wherein said electrophoresis display device is incorporated into one selected from the group consisting of mobile phone, video camera, personal computer, portable information terminal, digital camera, portable electronic book, television, and player using a recording medium.

4. A device according to claim 1, wherein said electrophoresis display device has flexibility.

5. A device according to claim 1, wherein the first plurality of microcapsules are just above all of the first thin film transistor, the fourth thin film transistor and the fifth thin film transistor.

6. A device according to claim 1, wherein the plurality of charged particles are controlled by potential of the first pixel electrode to display light and darkness.

7. An electrophoresis display device comprising:

a pixel region including at least a first sub pixel, a second sub pixel, and a third sub pixel, said first sub pixel comprising: a first SRAM; a first thin film transistor; a first pixel electrode; and a first plurality of microcapsules, said second sub pixel comprising: a second SRAM; a second thin film transistor; a second pixel electrode; and a second plurality of microcapsules, said third sub pixel comprising: a third SRAM; a third thin film transistor; a third pixel electrode; and a third plurality of microcapsules, wherein the first plurality of microcapsules are provided adjacent to the first pixel electrode, and a plurality of charged particles are embedded in the first plurality of microcapsules, wherein the first SRAM comprises at least two terminals, wherein one of a source and a drain of the first thin film transistor electrically connects to one of the at least two terminals of the first SRAM, and another terminal of the first SRAM electrically connects to the pixel electrode, wherein the first SRAM comprises a fourth thin film transistor and a fifth thin film transistor, and wherein the first pixel electrode is covering all of the first thin film transistor, the fourth thin film transistor and the fifth thin film transistor, and the first plurality of microcapsules are over the first pixel electrode, and all of the first thin film transistor, the fourth thin film transistor and the fifth thin film transistor.

8. A device according to claim 7 wherein said electrophoresis display device is incorporated into an electronic apparatus.

9. A device according to claim 7 wherein said electrophoresis display device is incorporated into one selected from the group consisting of mobile phone, video camera, personal computer, portable information terminal, digital camera, portable electronic book, television, and player using a recording medium.

10. A device according to claim 7, wherein said electrophoresis display device has flexibility.

11. A device according to claim 7, further comprising a source line, wherein the first sub pixel, second sub pixel, and third sub pixel share the source line.

12. A device according to claim 7, wherein the first plurality of microcapsules are just above all of the first thin film transistor, the fourth thin film transistor and the fifth thin film transistor.

13. A device according to claim 7, wherein the plurality of charged particles are controlled by potential of the first pixel electrode to display light and darkness.

14. An electrophoresis display device comprising:

a pixel region including at least a first sub pixel, a second sub pixel, and a third sub pixel, the first sub pixel comprising: a first SRAM; a first pixel electrode; a first thin film transistor, and a first plurality of microcapsules;

the second sub pixel comprising: a second SRAM; a second pixel electrode, a second thin film transistor, and a second plurality of microcapsules, the third sub pixel comprising: a third SRAM; a third pixel electrode, a third thin film transistor, and a third plurality of microcapsules, wherein the first plurality of microcapsules are provided adjacent to the first pixel electrode, and a plurality of charged particles are embedded in the first plurality of microcapsules, wherein the first SRAM comprises at least two terminals, wherein one of a source and a drain of the first thin film transistor electrically connects to one of the at least two terminals of the first SRAM, and another terminal of the first SRAM electrically connects to the first pixel electrode, wherein areas of the at least first sub pixel, second sub pixel, and third sub pixel are different from each other, wherein the first SRAM comprises a fourth thin film transistor and a fifth thin film transistor, and wherein the first pixel electrode is covering all of the first thin film transistor, the fourth thin film transistor and the fifth thin film transistor, and the first plurality of microcapsules are over the first pixel electrode, and all of the first thin film transistor, the fourth thin film transistor and the fifth thin film transistor.

15. A device according to claim 14 wherein said electrophoresis display device is incorporated into an electronic apparatus.

16. A device according to claim 14 wherein said electrophoresis display device is incorporated into one selected from the group consisting of mobile phone, video camera, personal computer, portable information terminal, digital camera, portable electronic book, television, and player using a recording medium.

17. A device according to claim 14, further comprising a source line, wherein the first sub pixel, second sub pixel, and third sub pixel share the source line.

18. A device according to claim 14, wherein said electrophoresis display device has flexibility.

19. A device according to claim 14, wherein the first plurality of microcapsules are just above all of the first thin film transistor, the fourth thin film transistor and the fifth thin film transistor.

20. A device according to claim 14, wherein the plurality of charged particles are controlled by potential of the first pixel electrode to display light and darkness.

21. An active matrix type electrophoresis display device comprising:

a first thin film transistor formed over a substrate;

a gate signal line formed over the substrate wherein a gate electrode of the first thin film transistor is electrically connected to the gate signal line;

a source signal line formed over the substrate and extending across the gate signal line wherein one of a source and a drain of the first thin film transistor is electrically connected to the source signal line;

an SRAM comprising a second thin film transistor and a third thin film transistor formed over the substrate wherein a first terminal of the SRAM is electrically connected to the other one of the source and the drain of the first thin film transistor;

a pixel electrode formed over the substrate wherein a second terminal of the SRAM is electrically connected to the pixel electrode; and a plurality of microcapsules including a, plurality of charged particles formed adjacent to the pixel electrode, wherein the pixel electrode is covering all of the first thin film transistor, the second thin film transistor and the third thin film transistor, and the plurality of microcapsules are over the pixel electrode, and all of the first thin film transistor, the second thin film transistor and the third thin film transistor.

22. A device according to claim 21, wherein the plurality of microcapsules are just above all of the first thin film transistor, the second thin film transistor and the third thin film transistor.

23. A device according to claim 21, wherein the plurality of charged particles are controlled by potential of the pixel electrode to display light and darkness.

* * * * *